US008726677B2

(12) United States Patent
Berson et al.

(10) Patent No.: US 8,726,677 B2
(45) Date of Patent: May 20, 2014

(54) WASTE HEAT AIR CONDITIONING SYSTEM

(75) Inventors: Yuval Berson, Moshav Aviel (IL); Amir Hirshfeld, Tel Aviv (IL)

(73) Assignee: Linum Systems Ltd., Pardes Hanna (IL)

( * ) Notice: Subject to any disclaimer, the term of this patent is extended or adjusted under 35 U.S.C. 154(b) by 313 days.

(21) Appl. No.: 13/262,639

(22) PCT Filed: Apr. 6, 2010

(86) PCT No.: PCT/IL2010/000272

§ 371 (c)(1),
(2), (4) Date: Oct. 2, 2011

(87) PCT Pub. No.: WO2010/113158

PCT Pub. Date: Oct. 7, 2010

(65) Prior Publication Data

US 2012/0023982 A1 Feb. 2, 2012

Related U.S. Application Data

(60) Provisional application No. 61/165,533, filed on Apr. 1, 2009.

(51) Int. Cl.
*F25B 1/00* (2006.01)
*F25B 41/00* (2006.01)

(52) U.S. Cl.
USPC ..... 62/116; 62/513

(58) Field of Classification Search
USPC ..... 62/79, 115, 116, 235.1, 238.6, 498, 62/500, 510, 513; 60/643, 645, 660, 670
See application file for complete search history.

(56) References Cited

U.S. PATENT DOCUMENTS

| | | | | |
|---|---|---|---|---|
| 2,418,911 A | | 4/1947 | Smith | |
| 3,068,659 A | * | 12/1962 | Marshall, Jr. | 62/50.3 |
| 3,153,422 A | | 10/1964 | Silvern | |
| 3,765,170 A | | 10/1973 | Nakamura | |
| 3,934,424 A | | 1/1976 | Goldsberry | |

(Continued)

FOREIGN PATENT DOCUMENTS

| | | |
|---|---|---|
| CN | 101000178 A | 7/2007 |
| GB | 2045361 A | 10/1980 |

(Continued)

OTHER PUBLICATIONS

International Search Report for Parallel International Application PCT/IL2010/000272, Issued by the European Patent Office of Mailing Date Sep. 10, 2010.

(Continued)

*Primary Examiner* — Judy Swann
*Assistant Examiner* — Christopher R Zerphey
(74) *Attorney, Agent, or Firm* — Simon Kahn

(57) ABSTRACT

The present disclosure provides for a method and apparatus of providing air conditioning from a waste heat source. A vapor state expander is provided producing mechanical work, and a compressing unit is at least partially operative responsive to the mechanical work output of the vapor state expander. In another exemplary embodiment a second liquid state expander producing mechanical work is further provided, the compressing unit operative further responsive to the mechanical work of the liquid state expander. The apparatus disclosed is further capable of providing backup heating and cooling from an additional power source when the waste heat source is insufficient.

13 Claims, 13 Drawing Sheets

(56) References Cited

U.S. PATENT DOCUMENTS

| | | | | |
|---|---|---|---|---|
| 3,952,519 | A | 4/1976 | Watson | |
| 4,191,164 | A | 3/1980 | Kelly | |
| 4,276,747 | A | 7/1981 | Faldella et al. | |
| 4,336,693 | A | 6/1982 | Hays et al. | |
| 4,372,124 | A | 2/1983 | Newton et al. | |
| 4,712,380 | A | 12/1987 | Smith | |
| 5,216,899 | A | 6/1993 | Fabris | |
| 5,467,613 | A | 11/1995 | Brasz | |
| 5,497,635 | A | 3/1996 | Alsenz | |
| 5,617,738 | A * | 4/1997 | Ikegami et al. | 62/509 |
| 5,705,916 | A | 1/1998 | Rudbeck et al. | |
| 5,822,990 | A | 10/1998 | Kalina et al. | |
| 5,833,446 | A | 11/1998 | Smith et al. | |
| 6,185,956 | B1 | 2/2001 | Brasz | |
| 6,250,099 | B1 | 6/2001 | Furuya et al. | |
| 6,269,644 | B1 | 8/2001 | Erickson et al. | |
| 6,289,692 | B1 | 9/2001 | Houser et al. | |
| 6,321,564 | B1 * | 11/2001 | Yamanaka et al. | 62/510 |
| 6,381,973 | B1 | 5/2002 | Bhatti et al. | |
| 6,581,384 | B1 * | 6/2003 | Benson | 60/653 |
| 6,962,056 | B2 | 11/2005 | Brasz et al. | |
| 7,178,358 | B2 | 2/2007 | Inaba et al. | |
| 7,343,913 | B2 | 3/2008 | Niedermeyer | |
| 7,437,875 | B2 | 10/2008 | Zuili et al. | |
| 7,523,621 | B2 | 4/2009 | Johansson | |
| 2002/0148225 | A1 | 10/2002 | Lewis | |
| 2004/0163697 | A1 | 8/2004 | Papadopoulos | |
| 2004/0238654 | A1 | 12/2004 | Hagen et al. | |
| 2005/0056051 | A1 | 3/2005 | Roberts et al. | |
| 2006/0005527 | A1 | 1/2006 | Kopko | |
| 2007/0199300 | A1 | 8/2007 | MacAdam et al. | |

FOREIGN PATENT DOCUMENTS

| | | | | |
|---|---|---|---|---|
| GB | 2114671 | A | 8/1983 | |
| GB | 2282852 | A | 4/1995 | |
| IT | WO 2008/142714 | * | 11/2008 | F25B 1/10 |
| JP | 58110320 | A | 6/1983 | |
| JP | 2003056932 | A | 2/2003 | |
| JP | 2004325018 | A | 11/2004 | |
| JP | 2006138288 | A | 6/2006 | |
| JP | 2006284085 | A | 10/2006 | |
| JP | 2006316704 | A | 11/2006 | |
| JP | 2007010220 | A | 1/2007 | |
| JP | 2007093046 | A | 4/2007 | |
| JP | 2007-132622 | | 5/2007 | |
| JP | 2008255959 | A | 10/2008 | |
| WO | 2005041396 | A2 | 5/2005 | |
| WO | 2007008225 | A2 | 1/2007 | |
| WO | 2007038921 | A1 | 4/2007 | |
| WO | 2008060196 | A1 | 5/2008 | |

OTHER PUBLICATIONS

Written Opinion of International Search Report for Parallel International Application PCT/IL2010/000272, Issued by the European Patent Office of Mailing Date Sep. 10, 2010.

First Office Action Dispatched Aug. 6, 2013 from China Patent Office for parallel patent application 201080015721.X.

First Office Action for parallel Japanese Application 2012-502876 dispatch date Feb. 18, 2014.

* cited by examiner

WASTE HEAT AIR CONDITIONING SYSTEM

CROSS-REFERENCE TO RELATED APPLICATIONS

This application claims priority from U.S. Provisional Patent Application Ser. No. 61/165,533 filed Apr. 1, 2009, of the above name, the entire contents of which are incorporated herein by reference.

TECHNICAL FIELD

The present disclosure relates generally to the field of air conditioning and in particular to a system and method for providing air conditioning from waste heat preferably utilizing a combination of a liquid phase expander and a vapor phase expander.

BACKGROUND ART

Many industrial processes produce waste heat of low temperature, typically less than 150° C., which is typically too low to be used to accomplish useful work. Certain thermodynamic cycles, such as absorption refrigeration, can provide environmental cooling from low grade heat sources. Similarly, solar thermal energy received in a solar collector such as a concentrating type or an evacuated tube type is typically of the order of waste heat, and has been employed in absorption chillers to provide environmental cooling. Unfortunately, the absorption refrigeration cycles typically used suffer from inefficiency, and are typically unable to achieve a thermal coefficient of performance (COP) greater than about 0.7, where the term COP is defined as $\Delta Qcold/\Delta Qin$, where $\Delta Qcold$ is defined as the change in heat of the load and $\Delta Qin$ is defined as the heat consumed by the cooling system. In vapor compression air conditioning, the COP is defined as $\Delta Qcold/\Delta W$, and is typically in the order of 3-3.5, where $\Delta Qcold$ is defined as above and $\Delta W$ is defined as the electrical work consumed by the cooling system. Furthermore, current state of the art waste heat driven A/C systems, such as absorption chillers utilizing the absorption refrigeration cycle, are incapable of operating in the absence of sufficient waste heat, and therefore require a complete additional system for backup.

U.S. Pat. No. 6,581,384 issued Jun. 24, 2003 to Benson, the entire contents of which is incorporated herein by reference is addressed to a process and apparatus for utilizing waste heat to power a reconfigurable thermodynamic cycle that can be used to selectively cool or heat an environmentally controlled space, such as a room or a building. Disadvantageously, the system of Benson requires, inter alia, a five way valve which adds to cost and complexity. Furthermore, the system of Benson exhibits a low overall COP, is incapable of operating in the absence of waste heat on residual power and is operative at temperatures of about 200° C., (400° F.) which increases cost.

What is desired is a method and system for providing air conditioning from waste heat which exhibits an improved overall coefficient of performance, preferably with the capacity to further provide backup heating and cooling when the waste heat source is unavailable

SUMMARY OF INVENTION

In view of the discussion provided above and other considerations, the present disclosure provides methods and apparatus to overcome some or all of the disadvantages of prior and present methods of providing air conditioning from waste heat. Other new and useful advantages of the present methods and apparatus will also be described herein and can be appreciated by those skilled in the art.

In an exemplary embodiment a vapor state expander is provided producing mechanical work, and a compressing unit is at least partially operative responsive to the mechanical work output of the vapor state expander. In another exemplary embodiment a second liquid state expander producing mechanical work is further provided, the compressing unit operative further responsive to the mechanical work of the liquid state expander.

In an exemplary embodiment an apparatus operative to provide air conditioning is provided, comprising: a control element; a first heat exchanger; a first expander arranged to produce mechanical work responsive to a refrigerant in a superheated vapor state, the first expander coupled to the output of the first heat exchanger; a compressor unit driven at least partially responsive to the produced mechanical work of the first expander; a condenser; and an evaporator, wherein in a waste heat cooling mode the control element is arranged to: feed the output of the first expander to the condenser; feed a first portion of the output of the condenser to the first heat exchanger; feed a second expanded portion of the output of the condenser to the evaporator; feed the output of the evaporator to the compressor unit; and feed the output of the compressor unit to the input of the condenser.

In one further embodiment the compressor unit comprises a compressor responsive to the produced mechanical work of the first expander and an additional power driven compressor, and wherein in an additional power source supported waste heat cooling mode the control element is arranged to: feed a first portion of the output of the evaporator to the compressor responsive to the produced mechanical work of the first expander; and feed a second portion of the output of the evaporator to the additional power driven compressor. In one yet further embodiment the apparatus additionally comprises: a second heat exchanger, arranged to heat refrigerant flowing there-through; and a second expander, the second expander arranged to produce mechanical work responsive to refrigerant in a liquid state, the compressor unit further driven at least partially responsive to the produced mechanical work of the second expander; wherein in a combined state dual waste heat cooling mode the control element is arranged to: feed the output of the condenser to the second heat exchanger; feed the first portion of the output of the condenser from the output of the second heat exchanger to the first heat exchanger; feed the second portion of the output of the condenser from the output of the second heat exchanger in a liquid state to the second expander; feed the output of the second expander to the input of the evaporator, thereby feeding the second expanded portion to the evaporator.

In one yet further embodiment, in the combined state dual waste heat cooling mode the pressure of the output of the first expander is consonant with the pressure of the output of the compressor unit. In another yet further embodiment the first heat exchanger and the second heat exchanger are arranged to transfer heat from a single waste heat source. In another yet additional further embodiment the waste heat source is a solar collector.

In one further embodiment the apparatus additionally comprises a pump responsive to the control element, wherein in the combined state dual waste heat cooling mode the control element is arranged to drive the refrigerant into the second heat exchanger via the pump. In another further embodiment the apparatus additionally comprises a pump responsive to the control element, and wherein in a waste heat driven heating mode the control element is arranged to: drive the refrigerant into the second heat exchanger via the pump; feed the refrigerant exiting the second heat exchanger to the first heat exchanger; and feed the output of the evaporator to the input of the pump.

In one further embodiment the apparatus additionally comprises: a second heat exchanger, arranged to cool refrigerant flowing there-through; and a second expander, the second expander arranged to produce mechanical work responsive to refrigerant in a liquid state, the compressor unit further driven at least partially responsive to the produced mechanical work of the second expander, the second expander coupled to the output of the second heat exchanger; wherein in a combined state waste heat cooling mode the control element is arranged to: feed the second portion of the output of the condenser to the second heat exchanger; and feed the output of the second expander to the input of the evaporator, thereby feeding the second expanded portion to the evaporator.

In one yet further embodiment, in the combined state waste heat cooling mode the pressure of the output of the first expander is consonant with the pressure of the output of the compressor unit. In another yet further embodiment the first heat exchanger is arranged to transfer heat from a solar collector. In another yet further embodiment the apparatus additionally comprises a pump responsive to the control element, and wherein in a waste heat driven heating mode the control element is arranged to: feed, via the pump, the output of the evaporator to the first heat exchanger; and feed the output of the first expander to the input of the evaporator.

In one further embodiment the apparatus additionally comprises an expansion valve, wherein in an additional power driven cooling mode the control element is arranged to: feed the output of the evaporator to the input of the compressor unit; feed the output of the compressor unit to the input of the condenser; and feed the output of the condenser to the evaporator via the expansion valve. In another further embodiment the apparatus additionally comprises an expansion valve, wherein in an additional power driven heating mode the control element is arranged to: feed the output of the condenser to the input of the compressor unit; feed the output of the second compressor to the input of the evaporator; and feed the output of the evaporator to the input of the condenser via the expansion valve.

Independently the embodiments further provide for a method of providing air conditioning comprising a waste heat cooling mode, the vapor state waste heat cooling mode comprising: providing a refrigerant; heating a first portion of the provided refrigerant to a vapor state; expanding the vapor state heated first portion of the provided refrigerant to produce a first mechanical work; evaporating a second portion of the provided refrigerant to provide cooling; compressing the evaporated second portion of the provided refrigerant at least partially responsive to the produced first mechanical work; and condensing the compressed second portion and the expanded first portion to a liquid state.

In one further embodiment the compressing is additionally responsive to an additional power source. In another further embodiment the expanding the vapor state heated first portion of the provided refrigerant is to a pressure consonant with the pressure of the compressed evaporated second portion.

In one further embodiment the method additionally comprises: pressurizing the condensed liquid state refrigerant. In one yet further embodiment the waste heat cooling mode is constituted of a combined state dual waste heat cooling mode, the combined state dual heat cooling mode further comprising: heating the second portion of the provided refrigerant while maintaining the provided refrigerant in a liquid state; and expanding the heated second portion in the liquid state to produce a second mechanical work, wherein the compressing is further responsive to the produced second mechanical work and wherein the evaporating is of the expanded heated second portion.

In one yet additional further embodiment the heating of the first portion and the heating of the second portion are responsive to a single waste heat source. In another yet additional further embodiment the waste heat source is a solar collector.

In one further embodiment the waste heat cooling mode is constituted of a combined state waste heat cooling mode, the combined state waste heat cooling mode further comprising: cooling the second portion of the provided refrigerant; and expanding the cooled second portion to produce a second mechanical work, wherein the compressing is further responsive to the produced second mechanical work and wherein the evaporating is of the expanded cooled second portion. In another further embodiment the method additionally comprises a waste heat driven heating mode, the waste heat driven heating mode comprises: heating the provided refrigerant to a vapor state; expanding the vapor state refrigerant; and condensing the expanded vapor state refrigerant thereby providing heating.

In one further embodiment the method additionally comprises an additional power driven cooling mode, the additional power driven cooling mode comprising: compressing the provided refrigerant in a vapor state responsive to an additional power source; condensing the compressed vapor state refrigerant to a liquid state; expanding the liquid state refrigerant; and evaporating the expanded refrigerant to the vapor state thereby providing cooling. In another further embodiment the method additionally comprises an additional power driven heating mode, the additional power driven heating mode comprising: compressing the provided refrigerant in a vapor state responsive to an additional power source; condensing the compressed vapor state provided refrigerant to a liquid state to thereby provide heating; expanding the liquid state provided refrigerant; and evaporating the expanded liquid state provided refrigerant to the vapor state.

Additional features and advantages of the invention will become apparent from the following drawings and description.

BRIEF DESCRIPTION OF DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DESCRIPTION OF EMBODIMENTS

Figure 1A:
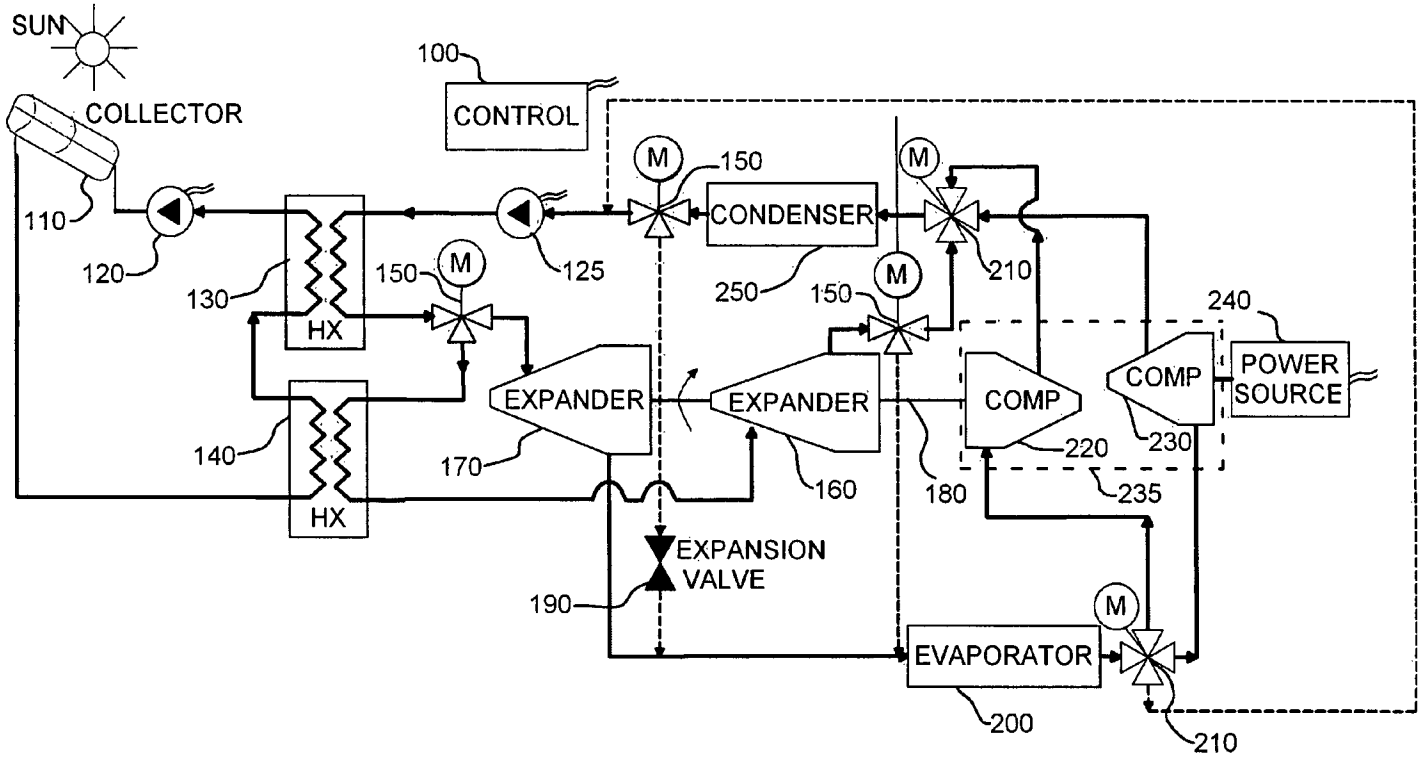
FIG. 1A illustrates a high level block diagram of an exemplary embodiment of an apparatus arranged to provide a combined state dual waste heat driven cooling cycle comprising a vapor phase expander and a liquid phase expander.

Before explaining at least one embodiment in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. In particular, the term connected as used herein is not meant to be limited to a direct connection, and allows for intermediary devices or components without limitation. Three way, four way and five way valves are shown as single elements for simplicity, but may be comprised of a plurality of cooperating valves without exceeding the scope.

FIG. 1A illustrates a high level block diagram of a first exemplary embodiment of an apparatus arranged to provide a combined state dual waste heat driven air conditioning cycle, the apparatus comprising: a control element 100; a waste heat source 110, illustrated without limitation as a solar collector; a first pump 120; a second pump 125; a first heat exchanger 130; a second heat exchanger 140; a first, second and third three way valve 150; a first expander 160; a second expander 170; a driving member 180; an expansion valve 190; an evaporator 200; a first and a second four way valve 210; a first compressor 220; a second compressor 230; an additional power source 240; and a condenser 250. First compressor 220 and second compressor 230 together form a compressor unit 235. First pump 120 is arranged to drive a working heat transfer fluid, which in one non-limiting embodiment is constituted of a water and ethylene glycol mixture, through waste heat source 110 and the heat source conduit of each of first and second heat exchangers 130 and 140 which are connected in a closed loop. Preferably, the heat source conduits of first and second heat exchangers 130 and 140 are connected serially, however the serial connection need not be direct and additional bypass piping and valves may be provided without exceeding the scope.

Respective outputs of control element 100 are connected to the control inputs of each of first, second and third three way valves 150, to the control input of each of first and second four way valves 210, to the control input of additional power source 240, to the control input of first pump 120 and to the control input of second pump 125. Control element 100 is further arranged to receive inputs from various temperature and pressure sensors (not shown) as known to those skilled in the art. The output of second pump 125 is connected to a first end of the heat receiving conduit of first heat exchanger 130 and a second end of the heat receiving conduit of first heat exchanger 130 is connected to a first tap of first three way valve 150. A second tap of first three way valve 150 is connected to a first end of the heat receiving conduit of second heat exchanger 140, and a second end of the heat receiving conduit of of second heat exchanger 140 is connected to the input of first expander 160. A third tap of first three way valve 150 is connected to the input of second expander 170, and the output of second expander 170 is connected to the input of evaporator 200. The output of first expander 160 is connected to a first tap of second three way valve 150, a second tap of second three way valve 150 is connected to a first tap of second four way valve 210 and a third tap of second three way valve 150 is connected to the input of evaporator 200, the connection to the input of evaporator 200 illustrated as a dashed line since it is not used in the waste heat driven cooling cycle of FIG. 1A.

Figure 2A:
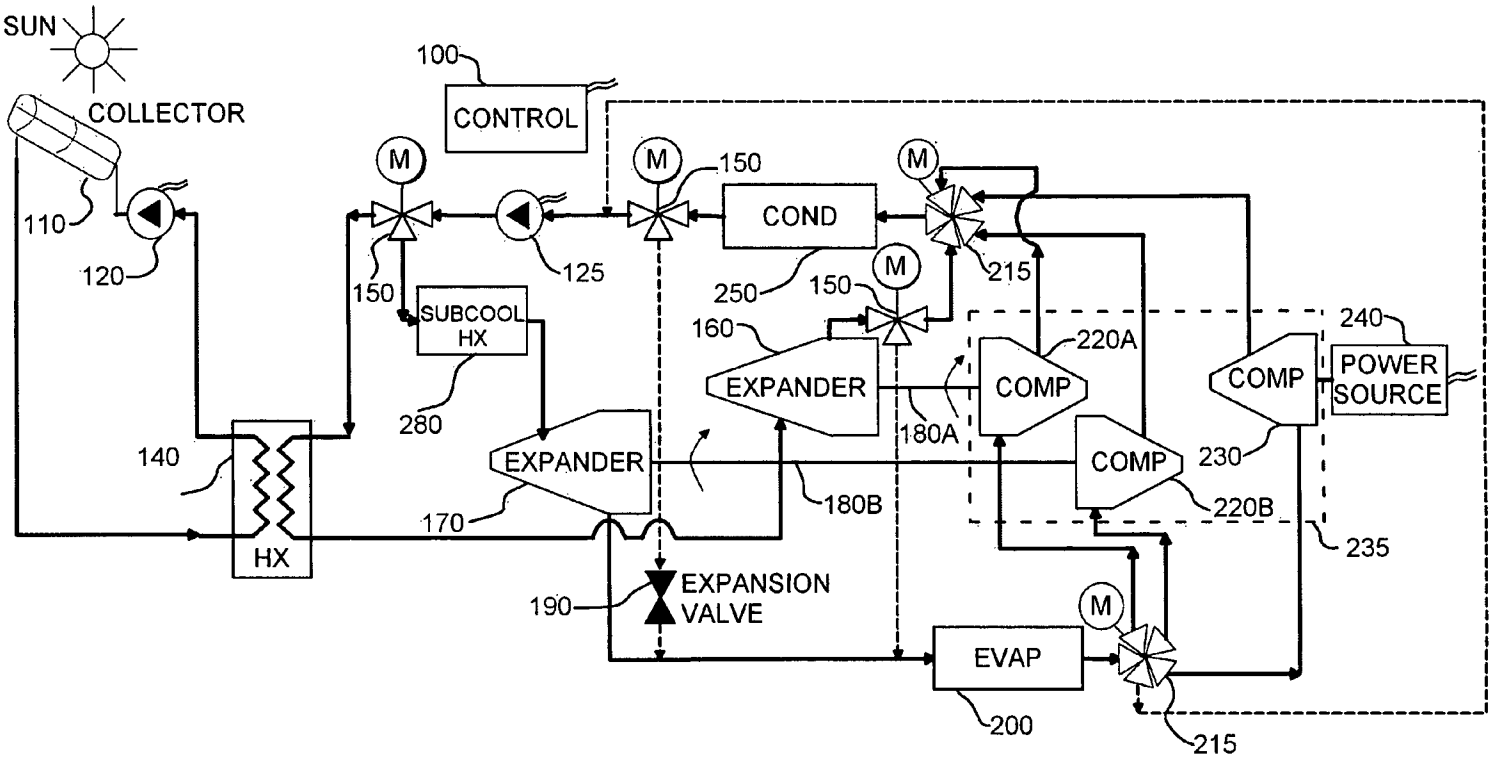
FIG. 2A illustrates a high level block diagram of a second exemplary embodiment of an apparatus arranged to provide a combined state waste heat driven cooling cycle comprising a vapor phase expander, a liquid phase expander and a subcooling heat exchanger.

First expander 160 and second expander 170 are illustrated as sharing driving member 180 with first compressor 220, however this is not meant to be limiting in any way, and in another embodiment, as described further in relation to FIG. 2A, each of first expander 160 and second expander 170 are associated with a particular compressor of compressing unit 235, the particular compressor operative responsive to mechanical work output by the respective expander. The output of evaporator 200 is connected to a first tap of first four way valve 210, a second tap of first four way valve 210 is connected to the input of first compressor 220, a third tap of first four way valve 210 is connected to the input of second compressor 230 and a fourth tap of first four way valve 210 is connected to the input of second pump 125, the connection to the input of second pump 125 illustrated as a dashed line since it is not used in the waste heat driven cooling cycle of FIG. 1A. The output of additional power source 240 is connected to the power input of second compressor 230. The output of second compressor 230 is connected to a second tap of second four way valve 210, the output of first compressor 220 is connected to a third tap of second four way valve 210 and the input of condenser 250 is connected to a fourth tap of second four way valve 210. The output of condenser 250 is connected to a first tap of third three way valve 150, the input of second pump 125 is connected to a second tap of third three way valve 150 and a third tap of third three way valve 150 is connected to the input of expansion valve 190, with the connection to the input of expansion valve 190 illustrated as a dashed line since it is not used in the waste heat driven cooling cycle of FIG. 1A. The output of expansion valve 190 is connected to the input of evaporator 200, the connection to the input of evaporator 200 illustrated as a dashed line since it is not used in the waste heat driven cooling cycle of FIG. 1A. In one embodiment, first and second four way valves 210 are implemented by respective control manifolds.

Figure 1B:
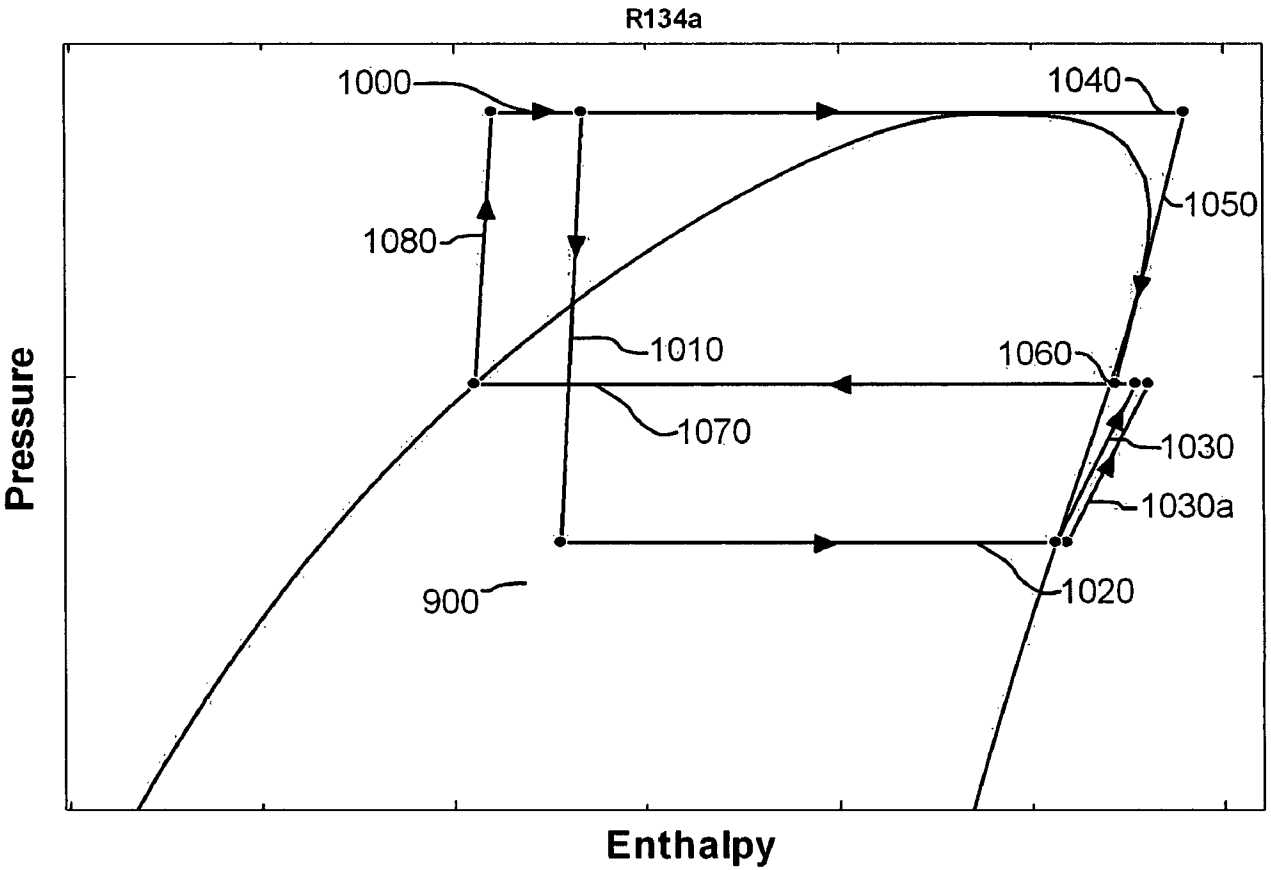
FIG. 1B illustrates a thermodynamic process in a pressure enthalpy diagram for the waste heat driven cooling cycle of FIG. 1A.

FIG. 1B illustrates a pressure enthalpy diagram for the waste heat driven cooling cycle of FIG. 1A, in which the x-axis represents enthalpy, and the y-axis represents pressure. Area 900 represents the wet vapor region for the refrigerant.

In operation, and with reference to both FIG. 1A and FIG. 1B, heated fluid from waste heat source 110 is forced through the heat source conduit of each of first and second heat exchangers 130 and 140 by first pump 120. Pressurized liquid refrigerant, which in one non-limiting embodiment is R-134a, and in one non-limiting embodiment is pressurized at 3-4 MPa, is forced into the heat receiving conduit of first heat exchanger 130 by second pump 125 and heated as shown in process 1000. The operating parameters of second pump 125 are controlled by control element 100 such that the pressurized liquid refrigerant exiting the heat receiving conduit of first heat exchanger 130 is maintained in a subcooled liquid state. In one non-limiting embodiment, the pressurized liquid refrigerant is heated to a temperature of 50-75° C. while passing through the heat receiving conduit of first heat exchanger 130. In particular, control element 100 is operative to control first pump 120 so as to maintain the temperature of the heat source side of first heat exchanger 130 to be within a predetermined range, thus defining the temperature of the pressurized liquid refrigerant exiting the heat receiving conduit of first heat exchanger 130.

Control element 100 is further operative to control first three way valve 150 so as to pass a portion of the subcooled liquid refrigerant exiting the heat receiving conduit of first heat exchanger 130 to the input of second expander 170, and the balance of the subcooled liquid refrigerant is passed to the heat receiving conduit of second heat exchanger 140.

Second expander 170, which may be implemented as a single or dual screw expander, scroll, rotary vane or reciprocating machine, is operative to expand the subcooled liquid refrigerant and impart rotational force to driving member 180, reducing the pressure and the temperature of the refrigerant as shown in process 1010. In one embodiment, second expander 170 is operative to convert a portion of the subcooled liquid refrigerant to a vapor state. The output of second expander 170 is fed to evaporator 200, where it completely evaporates as shown in process 1020 providing cooling for the surrounding space. Thus, second expander 170 is operative as a liquid phase expander arranged to impart rotational force to driving member 180 as a mechanical work output.

The output of evaporator 200 is split by first four way valve 210 and a first portion of the output of evaporator 200 is fed to the input of first compressor 220 and a second portion of the output of evaporator 200 is fed to the input of second compressor 230. The ratio of the first portion fed to first compressor 220 to the second portion fed to second compressor 230 is determined by control element 100 responsive to the power available from driving member 180. First and second compressors 220 and 230 are operative to compress the expanded vapor refrigerant received from evaporator 200, as shown in process 1030 and 1030A, respectively, to a slightly superheated vapor state. In one non-limiting embodiment, the slightly superheated vapor state is at a temperature of 40-55° C.

The portion of the subcooled liquid refrigerant passed to the heat receiving conduit of second heat exchanger 140 is further heated to a superheated vapor state in second heat exchanger 140, as shown in process 1040. In one embodiment, the refrigerant is heated in the heat receiving conduit of second heat exchanger 140 to a temperature of 85-115° C. The superheated vapor state refrigerant exiting the heat receiving conduit of second heat exchanger 140 is fed to first expander 160, which may be implemented as a gas turbine or a scroll or screw expander, without limitation, and is operative to expand the refrigerant thereby reducing the pressure and the temperature of the refrigerant as shown in process 1050, while retaining the refrigerant in a slightly superheated state and reducing the pressure of the refrigerant to a pressure consonant with the output of first and second compressors 220 and 230 described above. First expander 160 is further operative to produce mechanical work, particularly to impart rotational force to driving member 180. Thus, first expander 160 is operative as a vapor phase expander arranged to impart rotational force to driving member 180 as a work output, responsive to a vapor input, preferably a superheated vapor input. The operation of first and second expanders 160 and 170 is controlled by control element 100. In one embodiment, control element 100 receives an input indicative of the rotation rate of each of first and second expanders 160 and 170. In one embodiment integrated control valves are provided at the input of first and second expanders 160 and 170, the integrated control valves operative responsive to control element 100 to adjust the flow of refrigerant entering first and second expanders 160 and 170. In another embodiment, control element 100 is operative to control first expander 160 by adjusting the settings of one or more of first and second three way valves 150 so as to retain the refrigerant in a slightly superheated state and reduce the pressure of the refrigerant to a pressure consonant with the output of first and second compressors 220 and 230.

Second four way valve 210 is operative to receive the outputs of first and second compressors 220 and 230 and the output of first expander 160 via second three way valve 150, which as indicated above are at consonant pressures, mix the flows into a combined vapor exhibiting a unitary temperature and pressure, as shown in process 1060, and feed the combined refrigerant in vapor form to the input of condenser 250. Condenser 250, preferably in cooperation with ambient air or other cooling source, is operative to condense the received combined refrigerant to a liquid state, as shown in process 1070. The liquid state refrigerant exiting condenser 250 is transferred to second pump 125 through third three way valve 150, and pumped to an increased pressure as shown in process 1080, thus completing the cycle. As described above, in one non-limiting embodiment second pump 125 is operative to increase the pressure of the liquid refrigerant to a pressure of 3-4 MPa.

It is to be noted that preferably first expander 160 is thus operative on refrigerant arriving in the vapor state and second expander 170 is thus operative on refrigerant arriving in the liquid state. The thermal COP of the combination is calculated to be greater than 0.7, with the COP calculated as:

$$COP=Q_{evaporator}/(Q_{heat_source}) \quad \text{EQ. 1}$$

While the Electrical COP is calculated to be greater than 8 with the COP calculated as:

$$COP=Q_{evaporator}/\Delta W \quad \text{EQ. 2}$$

FIG. 2A illustrates a high level block diagram of a second exemplary embodiment of an apparatus arranged to provide a combined state waste heat driven air conditioning cycle, the apparatus comprising: a control element 100; a waste heat source 110, illustrated without limitation as a solar collector;

a first pump 120; a second pump 125; a heat exchanger 140; a first, second and third three way valve 150; a first expander 160; a second expander 170; a first driving member 180A and a second driving member 180B; an expansion valve 190; an evaporator 200; a first and a second five way valve 215; a first expander driven compressor 220A and a second expander driven compressor 220B; a compressor 230; an additional power source 240; a condenser 250; and a subcooling heat exchanger 280. First expander driven compressor 220A, second expander driven compressor 220B and compressor 230 together form a compressor unit 235. First pump 120 is arranged to drive a working heat transfer fluid, which in one non-limiting embodiment is constituted of a water and ethylene glycol mixture, through waste heat source 110 and the heat source conduit of heat exchanger 140.

Respective outputs of control element 100 are connected to the control inputs of each of first, second and third three way valves 150, to the control input of each of first and second five way valves 215, to the control input of additional power source 240, to the control input of first pump 120 and to the control input of second pump 125. Control element 100 is further arranged to receive inputs from various temperature and pressure sensors (not shown) as known to those skilled in the art. The output of second pump 125 is connected to a first tap of first three way valve 150. A second tap of first three way valve 150 is connected to a first end of the heat receiving conduit of heat exchanger 140, and a second end of the heat receiving conduit of heat exchanger 140 is connected to the input of first expander 160. A third tap of first three way valve 150 is connected to the input of subcooling heat exchanger 280. The output of subcooling heat exchanger 280 is connected to the input of second expander 170, and the output of second expander 170 is connected to the input of evaporator 200. The output of first expander 160 is connected to a first tap of second three way valve 150, a second tap of second three way valve 150 is connected to a first tap of second five way valve 215 and a third tap of second three way valve 150 is connected to the input of evaporator 200, the connection to the input of evaporator 200 illustrated as a dashed line since it is not used in the waste heat driven cooling cycle of FIG. 2A.

The output of evaporator 200 is connected to a first tap of first five way valve 215, a second tap of first five way valve 215 is connected to the input of first expander driven compressor 220A, a third tap of first five way valve 215 is connected to the input of second expander driven compressor 220B, a fourth tap of first five way valve 215 is connected to the input of compressor 230 and a fifth tap of first five way valve 215 is connected to the input of second pump 125, the connection to the input of second pump 125 illustrated as a dashed line since it is not used in the waste heat driven cooling cycle of FIG. 2A. The output of additional power source 240 is connected to the power input of compressor 230. The output of compressor 230 is connected to a second tap of second five way valve 215, the output of first expander driven compressor 220A is connected to a third tap of second five way valve 215, the output of second expander driven compressor 220B is connected to a fourth tap of second five way valve 215 and the input of condenser 250 is connected to a fifth tap of second five way valve 215. The output of condenser 250 is connected to a first tap of third three way valve 150, the input of second pump 125 is connected to a second tap of third three way valve 150 and a third tap of third three way valve 150 is connected to the input of expansion valve 190, with the connection to the input of expansion valve 190 illustrated as a dashed line since it is not used in the waste heat driven cooling cycle of FIG. 2A. The output of expansion valve 190 is connected to the input of evaporator 200, the connection to the input of evaporator 200 illustrated as a dashed line since it is not used in the waste heat driven cooling cycle of FIG. 2A. In one embodiment, first and second five way valves 215 are implemented by respective control manifolds. In one embodiment, condenser 250 and subcooling heat exchanger 280, which is preferably a condenser, are implemented in a single unit, thus requiring only one fan for both elements.

Figure 2B:
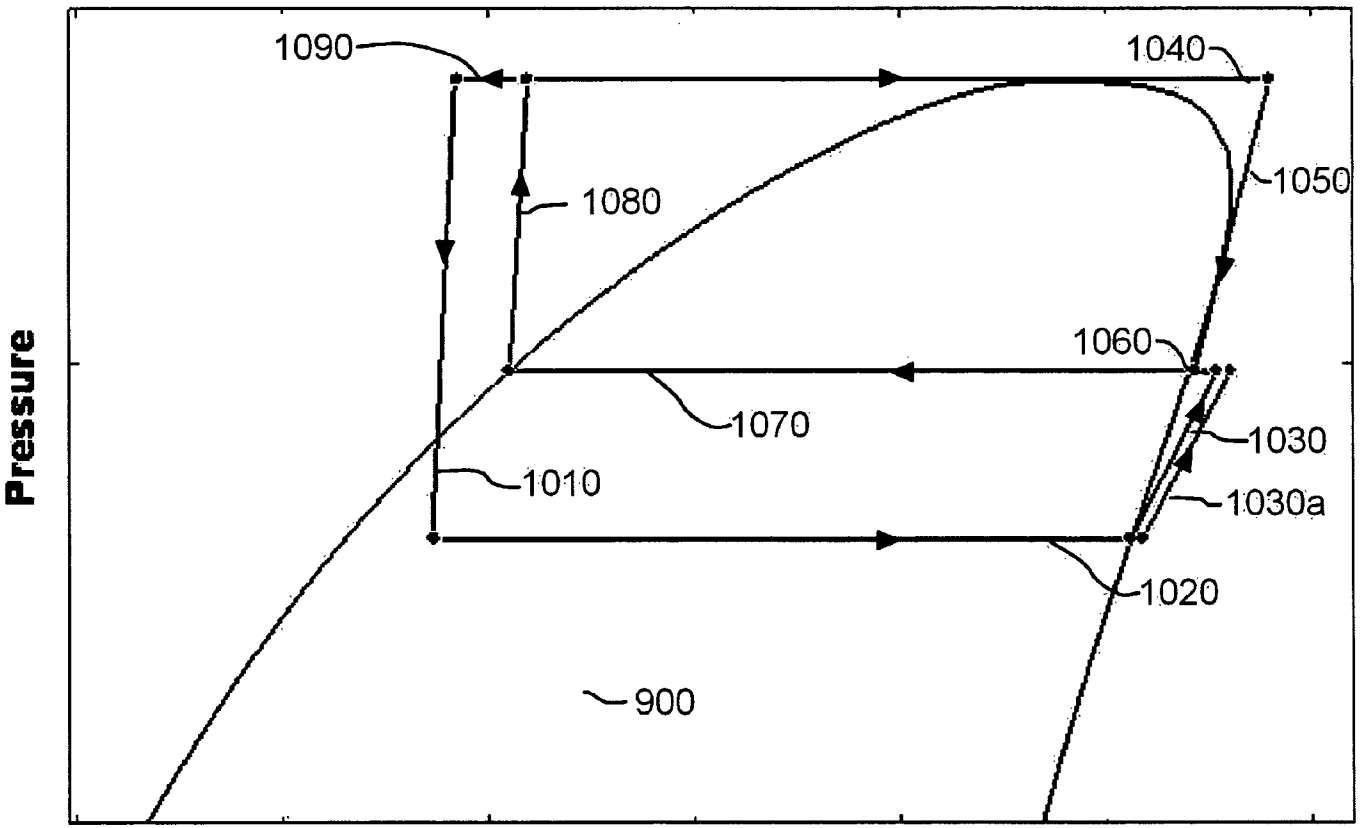
FIG. 2B illustrates a thermodynamic process in a pressure enthalpy diagram for the waste heat driven cooling cycle of FIG. 2A.

FIG. 2B illustrates a pressure enthalpy diagram for the waste heat driven cooling cycle of FIG. 2A, in which the x-axis represents enthalpy, and the y-axis represents pressure. Area 900 represents the wet vapor region for the refrigerant.

In operation, and with reference to both FIG. 2A and FIG. 2B, heated fluid from waste heat source 110 is forced through the heat source conduit of heat exchanger 140 by first pump 120. Pressurized liquid refrigerant, which in one non-limiting embodiment is R-134a, and in one non-limiting embodiment is pressurized at 3-4 MPa, is forced into first three way valve 150 by second pump 125. Control element 100 is operative to control first three way valve 150 so as to pass a portion of the pressurized liquid refrigerant into subcooling heat exchanger 280, where it is cooled as shown in process 1090, and the balance of the pressurized liquid refrigerant is passed to the heat receiving conduit of heat exchanger 140. The pressurized liquid refrigerant exiting subcooling heat exchanger 280 is in a subcooled liquid state and enters second expander 170. As indicated above, subcooling heat exchanger 280 is preferably integrated with condenser 250 so as to share a single fan. The refrigerant entering subcooling heat exchanger 280 preferably exhibits a temperature of 40-55° C., and subcooling heat exchanger 280 is preferably arranged to reduce the temperature of the portion of the refrigerant flowing there-through to within 2-5° C. above ambient temperature.

Second expander 170, which may be implemented as a single or dual screw expander, scroll, rotary vane or reciprocating machine, is operative to expand the subcooled liquid refrigerant and impart rotational force to second driving member 180B, reducing the pressure and the temperature of the refrigerant as shown in process 1010. In one embodiment, second expander 170 is operative to convert a portion of the subcooled liquid refrigerant to a vapor state. The output of second expander 170 is fed to evaporator 200, where it completely evaporates as shown in process 1020 providing cooling for the surrounding space. Thus, second expander 170 is operative as a liquid phase expander arranged to impart rotational force to second driving member 180B as a mechanical work output, which drives second expander driven compressor 220B.

The output of evaporator 200 is split by first five way valve 215 and a first portion of the output of evaporator 200 is fed to the input of first expander driven compressor 220A, a second portion of the output of evaporator 200 is fed to the input of second expander driven compressor 220B and a third portion of the output of evaporator 200 is fed to the input of compressor 230. The ratio of the various portions is determined by control element 100 responsive to the power available from each of first driving member 180A and second driving member 180B. Each of first expander driven compressor 220A, second expander driven compressor 220B and compressor 230 are operative to compress the expanded vapor refrigerant received from evaporator 200, as shown in process 1030 and 1030A, respectively, to a slightly superheated vapor state. In one non-limiting embodiment, the slightly superheated vapor state is at a temperature of 40-55° C. Preferably, the portions are further controlled such that the pressure of the vapor state refrigerant exiting each of first expander driven compressor 220A, second expander driven compressor 220B and compressor 230 are consonant.

The portion of the liquid refrigerant passed to the heat receiving conduit of heat exchanger 140 is heated to a superheated vapor state in heat exchanger 140, as shown in process 1040. In one non-limiting embodiment, the pressurized liquid refrigerant is heated to a temperature of 85-115° C. while passing through the heat receiving conduit of heat exchanger 140. The superheated vapor state refrigerant exiting the heat receiving conduit of heat exchanger 140 is fed to first expander 160, which may be implemented as a gas turbine or a scroll or screw expander, without limitation, and is operative to expand the refrigerant thereby reducing the pressure and the temperature of the refrigerant as shown in process 1050, while retaining the refrigerant in a slightly superheated state and reducing the pressure of the refrigerant to a pressure consonant with the output of first expander driven compressor 220A, second expander driven compressor 220B and compressor 230 described above. First expander 160 is further operative to produce mechanical work, particularly to impart rotational force to first driving member 180A. Thus, first expander 160 is operative as a vapor phase expander arranged to impart rotational force to first driving member 180A as a work output. The operation of first and second expanders 160 and 170 is controlled by control element 100. In one embodiment, control element 100 receives an input indicative of the rotation rate of each of first and second expanders 160 and 170. In one embodiment integrated control valves are provided at the input of first and second expanders 160 and 170, the integrated control valves operative responsive to control element 100 to adjust the flow of refrigerant entering first and second expanders 160 and 170. In another embodiment, control element 100 is operative to control first expander 160 by adjusting the settings of one or more of first and second three way valves 150 so as to retain the refrigerant in a slightly superheated state and reduce the pressure of the refrigerant to a pressure consonant with the respective outputs of first expander driven compressor 220A, second expander driven compressor 220B and compressor 230.

Second five way valve 215 is operative to receive the outputs of first expander driven compressor 220A, second expander driven compressor 220B, compressor 230 and the output of first expander 160 via second three way valve 150, which as indicated above are at consonant pressures, mix the flows into a combined vapor exhibiting a unitary temperature and pressure, as shown in process 1060, and feed the combined refrigerant in vapor form to the input of condenser 250. Condenser 250, preferably in cooperation with ambient air or other cooling source, is operative to condense the received combined refrigerant to a liquid state, as shown in process 1070. The liquid state refrigerant exiting condenser 250 is transferred to second pump 125 through third three way valve 150, and pumped to an increased pressure as shown in process 1080, thus completing the cycle. As described above, in one non-limiting embodiment second pump 125 is operative to increase the pressure of the liquid refrigerant to a pressure of 3-4 MPa.

It is to be noted that preferably first expander 160 is thus operative on refrigerant arriving in the vapor state and second expander 170 is operative on refrigerant arriving in the liquid state.

The thermal COP of the combination is calculated to be greater than 0.72, with the COP calculated as described above in relation to EQ. 1. The Electrical COP is calculated to be greater than 10 with the COP calculated as described above in relation to EQ. 2

Figure 3A:
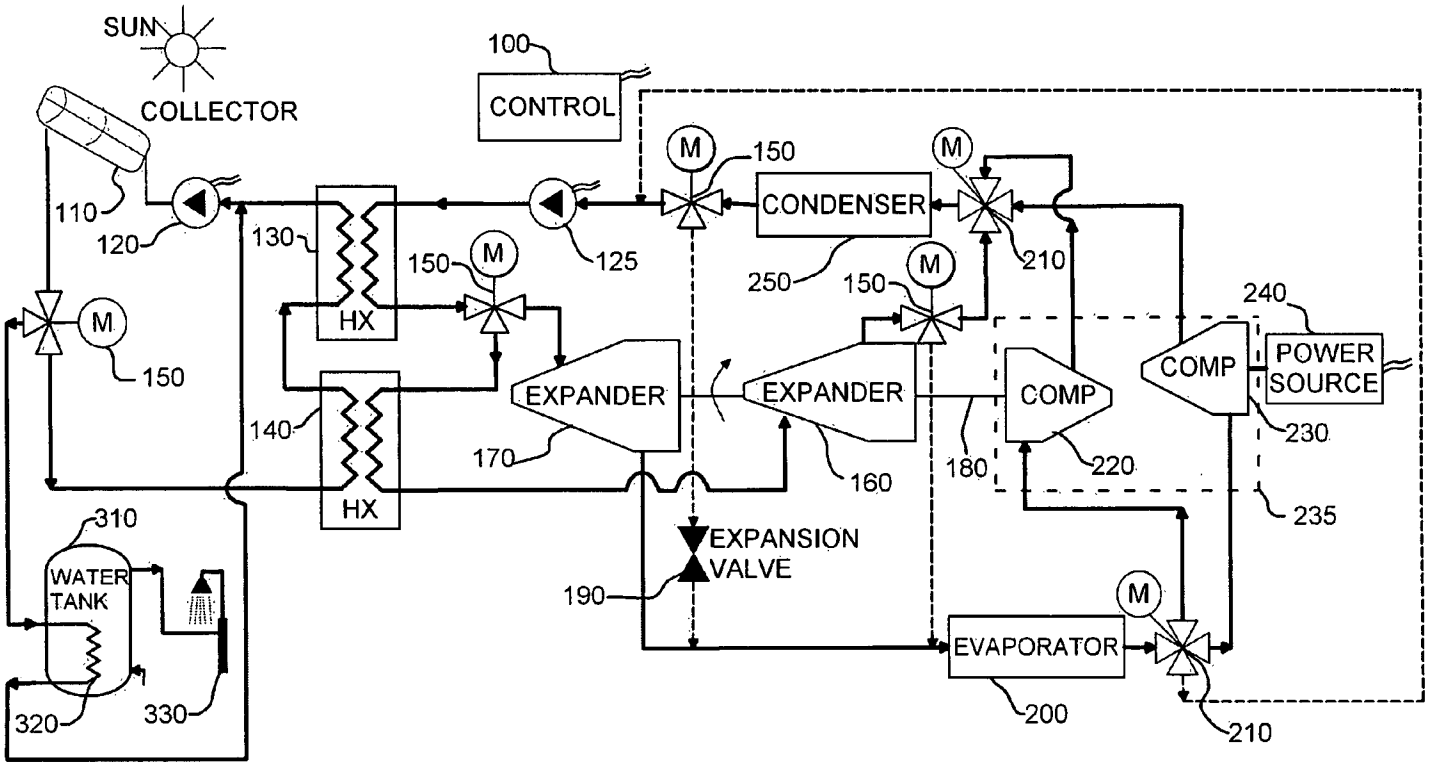
FIG. 3A illustrates a high level block diagram of an exemplary embodiment of the apparatus of FIG. 1A arranged to further provide domestic hot water heating.

FIG. 3A illustrates a high level block diagram of an exemplary embodiment of the apparatus of FIG. 1A arranged to further provide domestic hot water heating, the apparatus further comprising: a fourth three way valve 150; a hot water tank 310 comprising a heat exchanger 320; and a domestic hot water system 330. Fourth three way valve 150 is inserted within the closed loop of first pump 120, waste heat source 110 and the heat source side of first and second heat exchangers 130 and 140. In particular a first tap of fourth three way valve 150 is connected to the input of the heat source conduit of second heat exchanger 140 and a second tap of fourth three way valve 150 is connected to the output of waste heat source 110. A third tap of fourth three way valve 150 is connected to an input of a heat source conduit of heat exchanger 320 located within hot water tank 310 and the output of the heat source conduit of heat exchanger 320 is connected to the input of first pump 120. The control input of fourth three way valve 150 is connected to an output of control element 100. Water within hot water tank 310 is heated by the heated fluid flowing through the heat source conduit of heat exchanger 320, and is thus available for domestic hot water system 330

Respective outputs of control element 100 are further in communication with one or more of waste heat source 110, hot water tank 310 and fourth three way valve 150, which is preferably provided with a temperature sensor in hot water tank 310. Responsive to temperature information, and other system parameters, control element 100 is operative to adjust the setting of fourth three way valve 150 so as to flow at least a portion of the heated fluid pumped by first pump 120 through hot water tank 310.

Figure 3B:
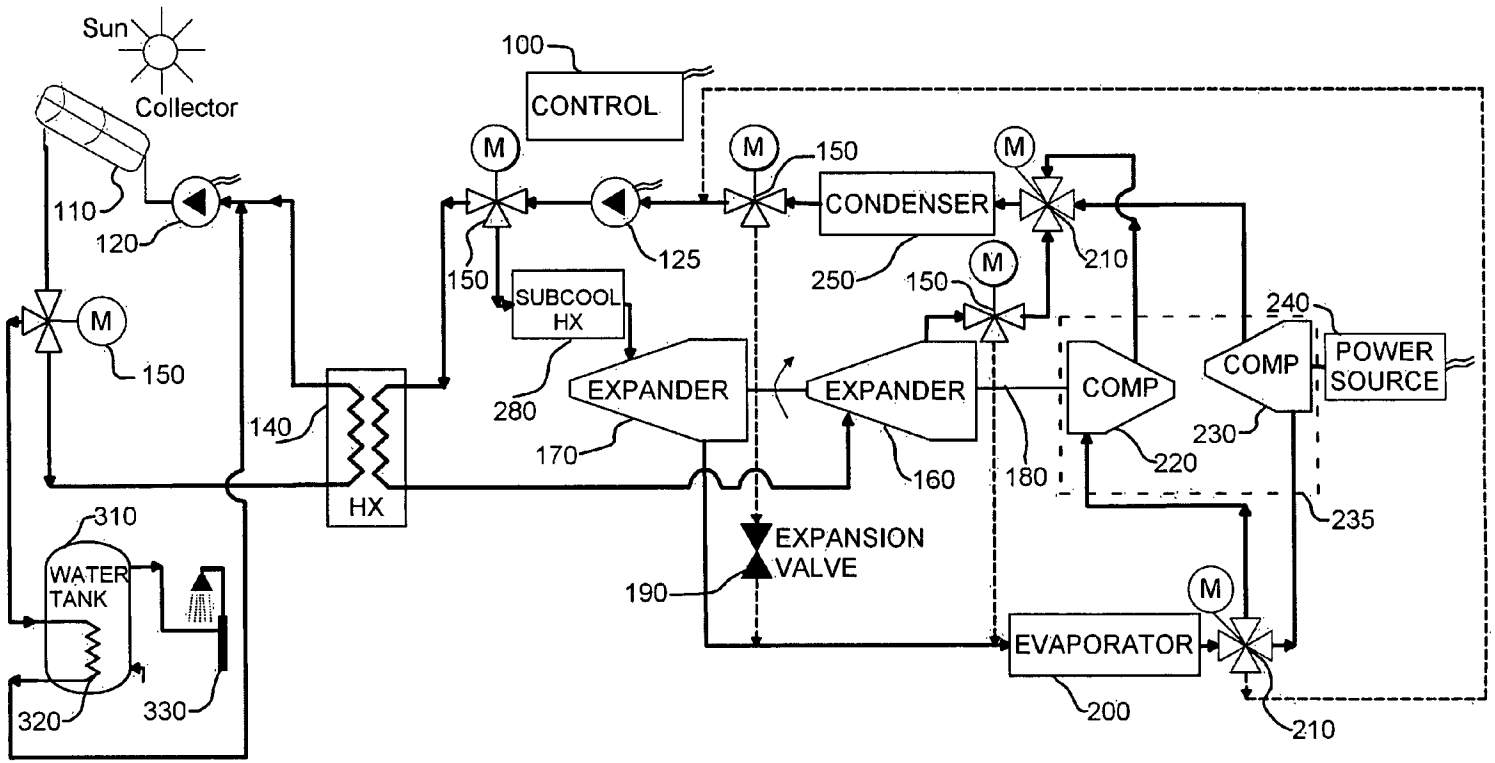
FIG. 3B illustrates a high level block diagram of an exemplary embodiment of the apparatus of FIG. 2A arranged to further provide domestic hot water heating.

FIG. 3B illustrates a high level block diagram of an exemplary embodiment of the apparatus of FIG. 2A arranged to further provide domestic hot water heating, the apparatus further comprising: a fourth three way valve 150; a hot water tank 310 comprising a heat exchanger 320; and a domestic hot water system 330. Fourth three way valve 150 is inserted within the closed loop of first pump 120, waste heat source 110 and the heat source side of heat exchanger 140. In particular a first tap of fourth three way valve 150 is connected to the input of the heat source conduit of heat exchanger 140 and a second tap of fourth three way valve 150 is connected to the output of waste heat source 110. A third tap of fourth three way valve 150 is connected to an input of a heat source conduit of heat exchanger 320 located within hot water tank 310 and the output of the heat source conduit of heat exchanger 320 is connected to the input of first pump 120. The control input of fourth three way valve 150 is connected to an output of control element 100. Water within hot water tank 310 is heated by the heated fluid flowing through the heat source conduit of heat exchanger 320, and is thus available for domestic hot water system 330. For the sake of simplicity, first and second expanders 160 and 170 are illustrated as sharing driving member 180 driving compressor 220, as described above in relation to FIG. 1A, however this is not meant to be limiting in any way. In another embodiment first and second expanders 160, 170 each drive a respective driving member each associated with a respective compressor, without exceeding the scope.

Respective outputs of control element 100 are further in communication with one or more of waste heat source 110, hot water tank 310 and fourth three way valve 150, which is preferably provided with a temperature sensor in hot water tank 310. Responsive to temperature information, and other system parameters, control element 100 is operative to adjust the setting of fourth three way valve 150 so as to flow at least a portion of the heated fluid pumped by first pump 120 through hot water tank 310.

Figure 4A:
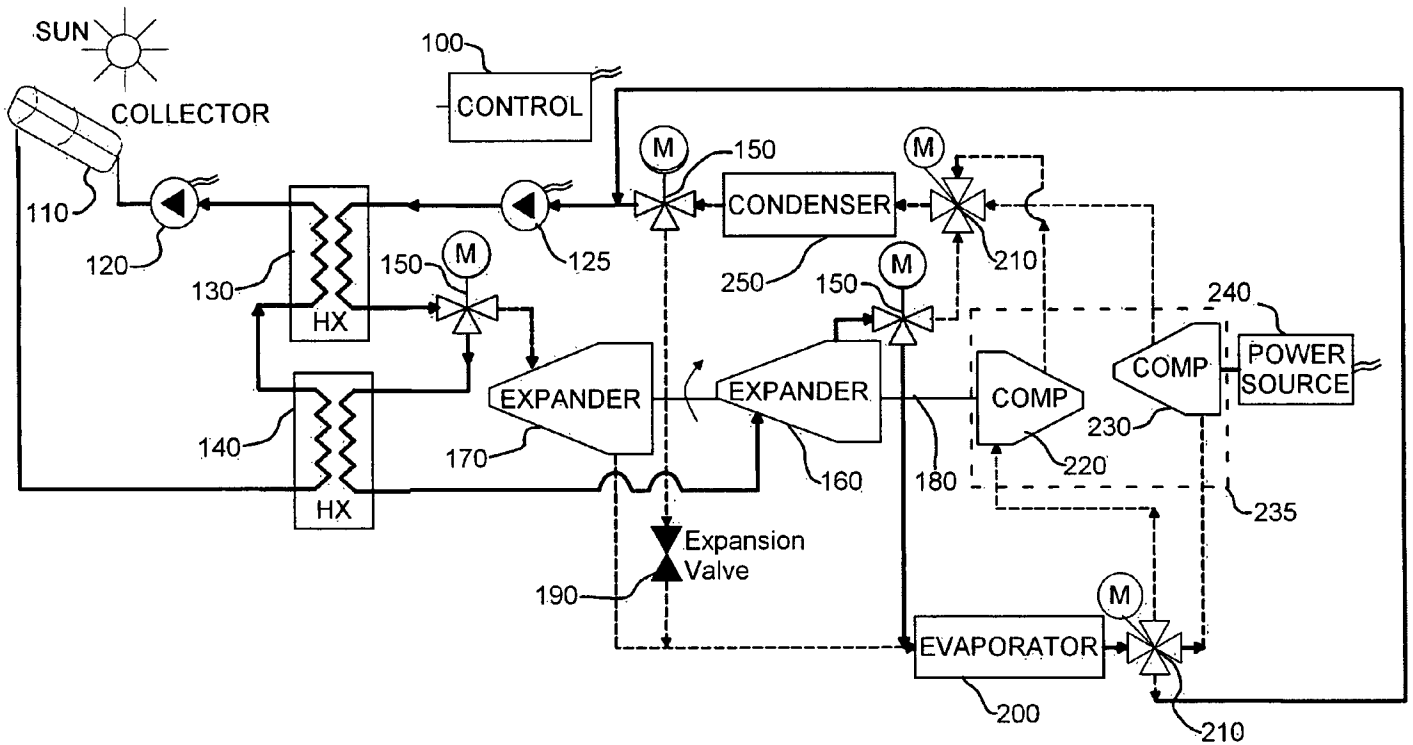
FIG. 4A illustrates a high level block diagram of an exemplary embodiment of the apparatus of FIG. 1A further arranged to provide a waste heat driven heating cycle.

FIG. 4A illustrates a high level block diagram of an exemplary embodiment of the apparatus of FIG. 1A further arranged to provide a waste heat driven heating cycle. The connections between each of: the third tap of first three way valve 150 and the input of second expander 170; the output of second expander 170 and the input of evaporator 200; the second tap of second three way valve 150 and the first tap of second four way valve 210; the second tap of first four way valve 210 and the input of first compressor 220; the third tap of first four way valve 210 and the input of second compressor 230; the output of second compressor 230 and the second tap of second four way valve 210; the output of first compressor 220 and the third tap of second four way valve 210; the input of condenser 250 and the fourth tap of second four way valve 210; the output of condenser 250 and the first tap of third three way valve 150; the third tap of third three way valve 150 and the input of expansion valve 190; and the output of expansion valve 190 and the input of evaporator 200 are illustrated as dashed lines since they are not used in the waste heat driven heating cycle of FIG. 4A.

Figure 4B:
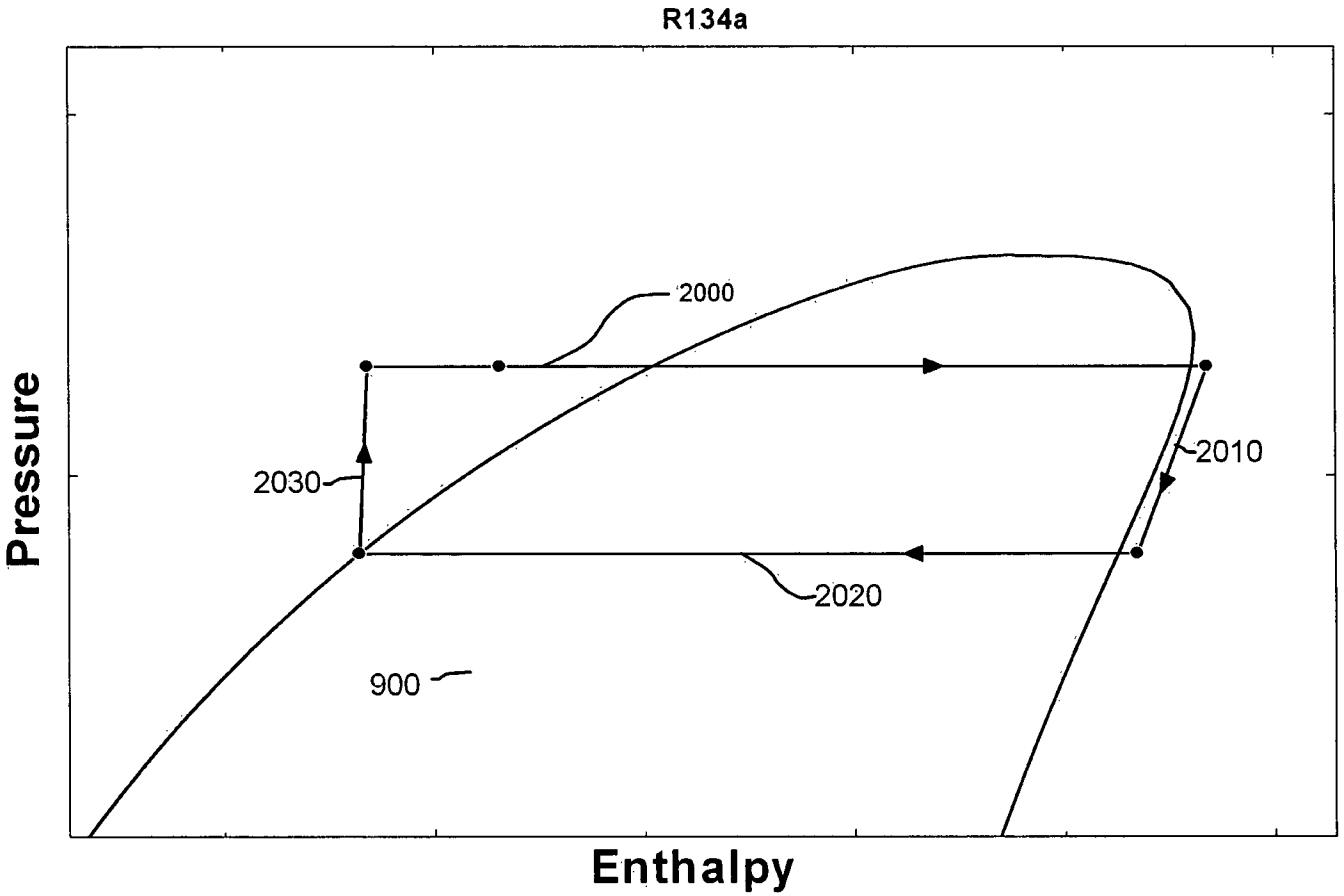
FIG. 4B illustrates a thermodynamic process in a pressure enthalpy diagram for the waste heat driven heating cycle of FIG. 4A.

FIG. 4B illustrates a pressure enthalpy diagram for the waste heat driven heating cycle of FIG. 4A, in which the x-axis represents enthalpy, and the y-axis represents pressure. Area 900 represents the wet vapor region for the refrigerant.

In operation, and with reference to both FIG. 4A and FIG. 4B, heated fluid from waste heat source 110 is forced through the heat source conduit of each of first and second heat exchangers 130 and 140 by first pump 120. Pressurized liquid refrigerant, which in one non-limiting embodiment is R-134a, and in one non-limiting embodiment is pressurized at 1.5-2.5 MPa, is forced into the heat receiving conduit of first heat exchanger 130 by second pump 125. It is to be noted that the pressure of the liquid refrigerant entering the heat receiving conduit of first heat exchanger 130 is not required to be the same as the pressure in the waste heat driven cooling cycle of FIG. 1A, and in the illustrative embodiment is lower.

First three way valve 150 is set responsive to control element 100 to preferably pass all of the pressurized liquid refrigerant exiting the heat receiving conduit of first heat exchanger 130 into the input of the heat receiving conduit of second heat exchanger 140. The pressurized liquid refrigerant is thus heated by the actions of first and second heat exchangers 130 and 140, as shown in process 2000, to a superheated vapor state. In one non-limiting embodiment, the temperature of the pressurized liquid refrigerant exiting the heat receiving conduit of first heat exchanger 130 is 50-70° C., which represents a subcooled liquid state. The subcooled refrigerant is then heated by second heat exchanger 140 and the temperature of the pressurized liquid refrigerant exiting the heat receiving conduit of second heat exchanger 140 is 70-85° C., depending on pressure, which represents the superheated vapor state mentioned above. The operating parameters of first and second pumps 120 and 125 are controlled by control element 100 such that the pressurized liquid refrigerant exiting second heat exchanger 140 is maintained in the desired superheated vapor state.

The superheated vapor state refrigerant exiting the heat receiving conduit of second heat exchanger 140 is fed to first expander 160, which may be implemented as a gas turbine or a scroll or screw expander, without limitation, and is operative to expand the refrigerant thereby reducing the pressure and the temperature of the refrigerant as shown in process 2010, while retaining the refrigerant in a slightly superheated vapor state at a temperature appropriate for use with evaporator 200. The superheated vapor state refrigerant further performs mechanical work rotating driving member 180, however the mechanical work is not used in the system and is discarded, preferably by means of a mechanical clutch (not shown). Control element 100 is operative to control the operation of first expander 160 so as to achieve the desired output pressure and temperature. In one non-limiting embodiment, the desired output temperature of first expander 160 in the waste heat driven heating cycle is about 30-45° C.

The output of first expander 160 is fed to evaporator 200 via second three way valve 150, and evaporator 200 serves as a condenser in the waste driven heating cycle. In particular, the slightly superheated vapor state refrigerant entering evaporator 200 passes heat to the air surrounding evaporator 200, cooling the refrigerant which acts to change phase to a liquid state as shown in process 2020, while heating the served space. The liquid refrigerant exiting evaporator 200 is transferred to second pump 125 through first four way valve 210, and pumped to an increased pressure as shown in process 2030, thus completing the cycle. As described above, in one non-limiting embodiment second pump 125 is operative to increases the pressure of the liquid refrigerant to a pressure of 1.5-2.5 MPa.

The COP of the waste heat driven heating cycle is calculated to be greater than 2.5, with the COP calculated as described above in relation to EQ. 1.

Figure 5:
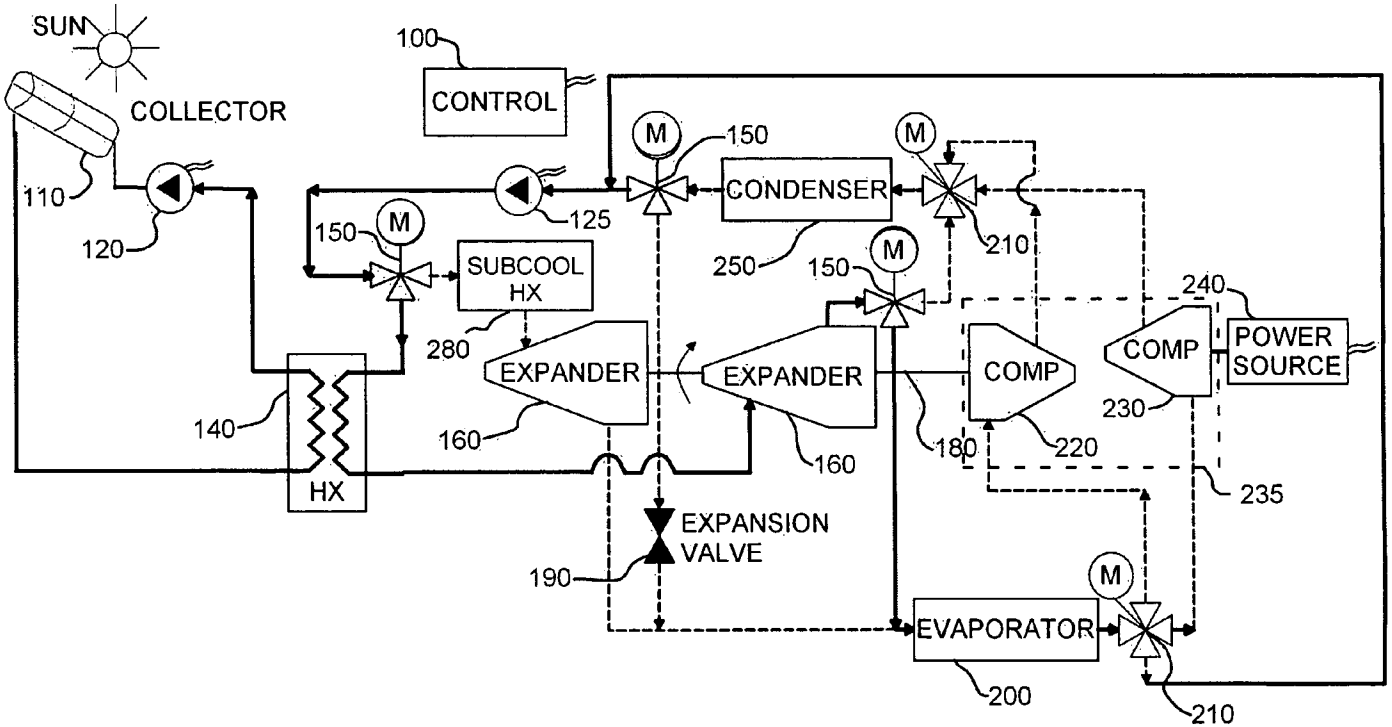
FIG. 5 illustrates a high level block diagram of an exemplary embodiment of the apparatus of FIG. 2A further arranged to provide a waste heat driven heating cycle.

FIG. 5 illustrates a high level block diagram of an exemplary embodiment of the apparatus of FIG. 2A further arranged to provide a waste heat driven heating cycle. The connections between each of: the third tap of first three way valve 150 and the input of subcooling heat exchanger 280; the output of subcooling heat exchanger 280 and the input of second expander 170; the output of second expander 170 and the input of evaporator 200; the second tap of second three way valve 150 and the first tap of second four way valve 210; the second tap of first four way valve 210 and the input of first compressor 220; the third tap of first four way valve 210 and the input of second compressor 230; the output of second compressor 230 and the second tap of second four way valve 210; the output of first compressor 220 and the third tap of second four way valve 210; the input of condenser 250 and the fourth tap of second four way valve 210; the output of condenser 250 and the first tap of third three way valve 150; the third tap of third three way valve 150 and the input of expansion valve 190; and the output of expansion valve 190 and the input of evaporator 200 are illustrated as a dashed line since they are not used in the waste heat driven heating cycle of FIG. 5. For the sake of simplicity, first and second expanders 160 and 170 are illustrated as sharing driving member 180 driving compressor 220, as described above in relation to FIG. 1A, however this is not meant to be limiting in any way. In another embodiment first and second expanders 160, 170 each drive a respective driving member each associated with a respective compressor, without exceeding the scope.

The operation of the apparatus of FIG. 5 is in all respects similar to the operation of the apparatus of FIG. 4A, described above in cooperation with FIG. 4B, with the exception that the refrigerant is heated through only one heat exchanger, i.e. heat exchanger 140, and therefore for the sake of brevity will not be further described.

Figure 6:
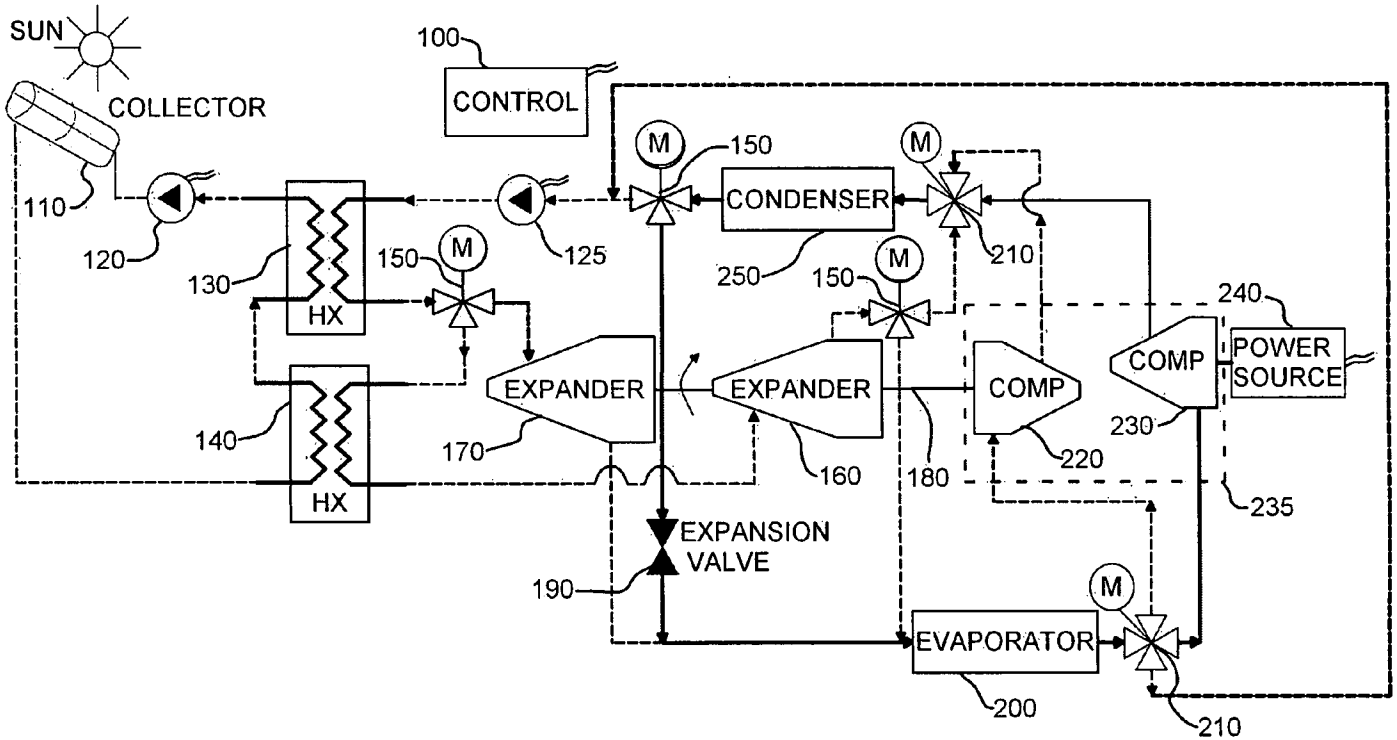
FIG. 6 illustrates a high level block diagram of an exemplary embodiment of the apparatus of FIG. 1A further arranged to provide an additional power driven cooling cycle.

FIG. 6 illustrates a high level block diagram of an exemplary embodiment of the apparatus of FIG. 1A further arranged to provide an additional power driven cooling cycle. In one non-limiting embodiment, the additional power is electrical power, as shown connected to power source 240. The connections between each of: first pump 120 and waste heat source 110; first and second heat exchangers 130 and 140; The output of second pump 125 and the first end of the heat receiving conduit of first heat exchanger 130; and the second end of the heat receiving conduit of first heat exchanger 130 and the first tap of first three way valve 150; the second tap of first three way valve 150 and the first end of the heat receiving conduit of second heat exchanger 140; the second end of the heat receiving conduit of second heat exchanger 140 and the input of first expander 160, the third tap of first three way valve 150 and the input of second expander 170; the output of second expander 170 and the input of evaporator 200; the output of first expander 160 and the first tap of second three way valve 150; the second tap of second three way valve 150 and the first tap of second four way valve 210; the third tap of second three way valve 150 and the input of evaporator 200; the second tap of first four way valve 210 and the input of first compressor 220; the fourth tap of first four way valve 210 and the input of second pump 125; the output of first compressor 220 and the third tap of second four way valve 210; and the input of second pump 125 and the second tap of third three way valve 150 are illustrated as a dashed line since they are not used in the additional power driven cooling cycle of FIG. 6.

Additional power source 240 may represent electrical mains based power, or battery operated power without limitation. It is to be noted that the operation of the additional power driven cooling cycle of FIG. 6 is in all respects similar to a common air conditioning cooling cycle, and thus in the interest of brevity is not further described.

Figure 7:
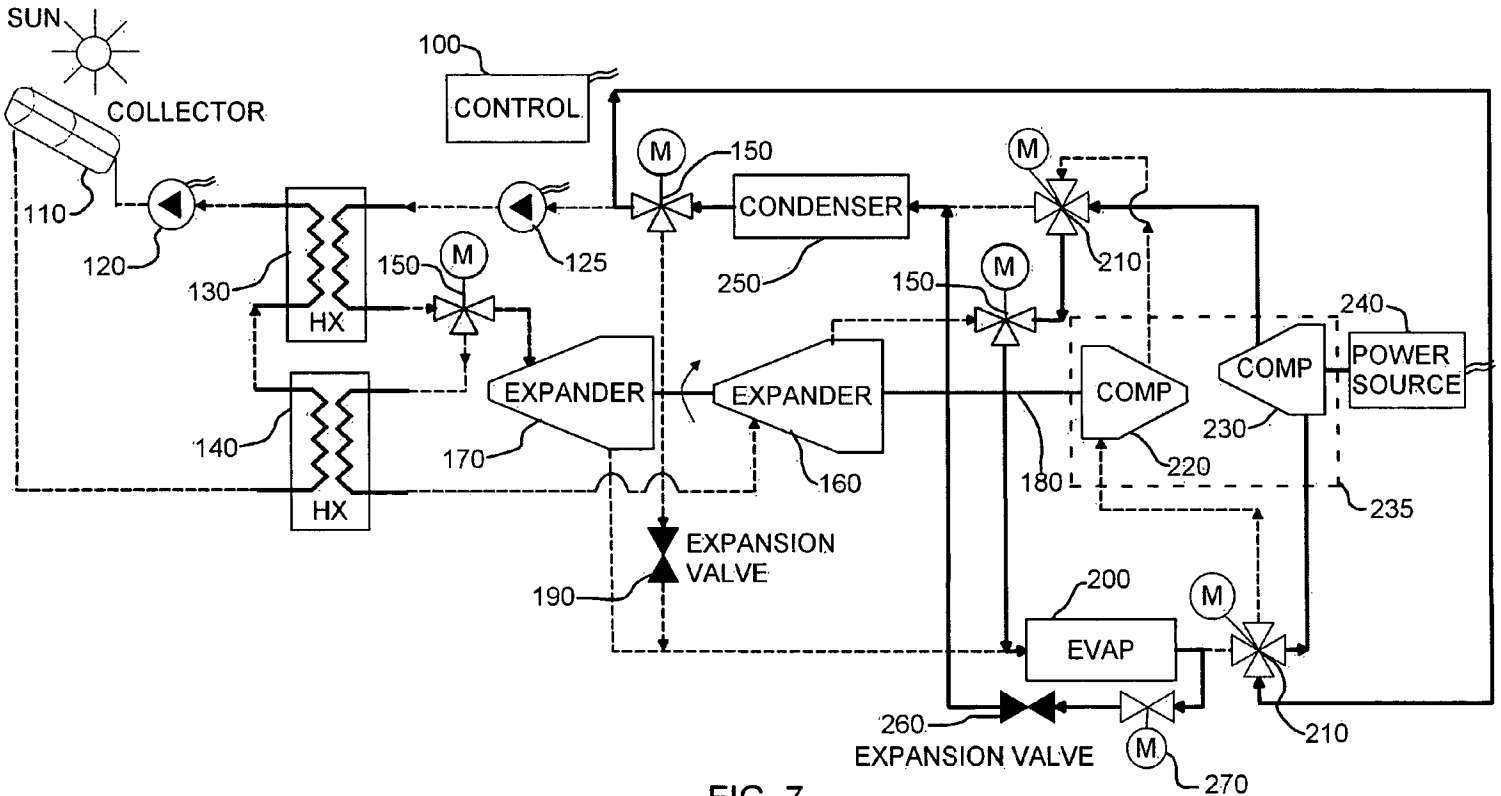
FIG. 7 illustrates a high level block diagram of an exemplary embodiment of the apparatus of FIG. 1A further arranged to provide an additional power driven heating cycle.

FIG. 7 illustrates a high level block diagram of an exemplary embodiment of the apparatus of FIG. 1A further arranged to provide an additional power driven heating cycle. In one non-limiting embodiment, the additional power is electrical power. It is to be noted that certain elements not present in the apparatus of FIG. 1A are added, however these elements may be added to the apparatus of FIG. 1A with the appropriate valves without impacting the operation of the apparatus of FIG. 1A. The apparatus of FIG. 7 comprises: a control element 100; a waste heat source 110, illustrated without limitation as a solar collector; a first pump 120 and a second pump 125; a first heat exchanger 130; a second heat exchanger 140; a first, second and third three way valve 150; a first expander 160; a second expander 170; a driving member 180; an expansion valve 190; an evaporator 200; a first and a second four way valve 210; a first compressor 220; a second compressor 230; an additional power source 240; a condenser 250; an expansion valve 260; and a two way valve 270. First compressor 220 and second compressor 230 together form a compressor unit 235. First pump 120 is arranged to drive a working heat transfer fluid, which in one non-limiting embodiment is constituted of a water and ethylene glycol mixture, through waste heat source 110 and the heat source conduit of each of first and second heat exchangers 130 and 140 which are connected in a closed loop, the connection illustrated as a dashed line since it is not used in the additional power driven cooling cycle of FIG. 6. Preferably, the heat source conduits of first and second heat exchanger 130 and 140 are connected serially, however the serial connection need not be direct and additional bypass piping and valves may be provided without exceeding the scope.

Respective outputs of control element 100 are connected to the control inputs of each of first, second and third three way valves 150, to the control input of each of first and second four way valves 210, to the control input of additional power source 240, to the control input of first pump 120, to the control input of second pump 125, and to the control input of two way valve 270. Control element 100 is further arranged to receive inputs from various temperature and pressure sensors (not shown) as known to those skilled in the art. The output of second pump 125 is connected to a first end of the heat receiving conduit of first heat exchanger 130, the connection illustrated as a dashed line since it is not used in the additional power driven heating cycle of FIG. 7, and a second end of the heat receiving conduit of first heat exchanger 130 is connected to a first tap of first three way valve 150, the connection illustrated as a dashed line since it is not used in the additional power driven heating cycle of FIG. 7. A second tap of first three way valve 150 is connected to a first end of the heat receiving conduit of second heat exchanger 140, the connection illustrated as a dashed line since it is not used in the additional power driven heating cycle of FIG. 7, and a second end of the heat receiving conduit of second heat exchanger 140 is connected to the input of first expander 160, the connection illustrated as a dashed line since it is not used in the additional power driven heating cycle of FIG. 7. A third tap of first three way valve 150 is connected to the input of second expander 170, the connection illustrated as a dashed line since it is not used in the additional power driven heating cycle of FIG. 7, and the output of second expander 170 is connected to the input of evaporator 200, the connection illustrated as a dashed line since it is not used in the additional power driven heating cycle of FIG. 7.

The output of first expander 160 is connected to a first tap of second three way valve 150, the connection illustrated as a dashed line since it is not used in the additional power driven heating cycle of FIG. 7, a second tap of second three way valve 150 is connected to a first tap of second four way valve 210, and a third tap of second three way valve 150 is connected to the input of evaporator 200. Second expander 170 and first expander 160 share driving member 180 with first compressor 220. The output of evaporator 200 is connected to a first tap of first four way valve 210, the connection illustrated as a dashed line since it is not used in the additional power driven heating cycle of FIG. 7, a second tap of first four way valve 210 is connected to the input of first compressor 220, the connection illustrated as a dashed line since it is not used in the additional power driven heating cycle of FIG. 7, and a third tap of first four way valve 210 is connected to the input of second compressor 230. The output of additional power source 240 is connected to the power input of second compressor 230. The output of second compressor 230 is connected to a second tap of second four way valve 210, the output of first compressor 220 is connected to a third tap of second four way valve 210, the connection illustrated as a dashed line since it is not used in the additional power driven heating cycle of FIG. 7, and the input of condenser 250 is connected to a fourth tap of second four way valve 210, the connection illustrated as a dashed line since it is not used in the additional power driven heating cycle of FIG. 7. The input of condenser 250 is further connected to the output of expansion valve 260. The output of condenser 250 is connected to a first tap of third three way valve 150, the input of second pump 125 is connected to a second tap of third three way valve 150, the connection illustrated as a dashed line since it is not used in the additional power driven heating cycle of FIG. 7, and a third tap of third three way valve 150 is connected to the input of expansion valve 190, the connection illustrated as a dashed line since it is not used in the additional power driven heating cycle of FIG. 7. The second tap of third three way valve 150 is further connected to the fourth tap of first four way valve 210. The output of expansion valve 190 is connected to the input of evaporator 200, the connection illustrated as a dashed line since it is not used in the additional power driven heating cycle of FIG. 7. A second end of expansion valve 260 is connected to a first tap of two way valve 270, and a second tap of two way valve 270 is connected to the output of evaporator 200.

Additional power source 240 may represent electrical mains based power, or battery operated power without limitation. It is to be noted that the operation of the additional power driven cooling cycle of FIG. 7 is in all respects similar to a common air conditioning heat mode cycle, with condenser 250 acting as an evaporator, and thus in the interest of brevity is not further detailed.

Figure 8A:
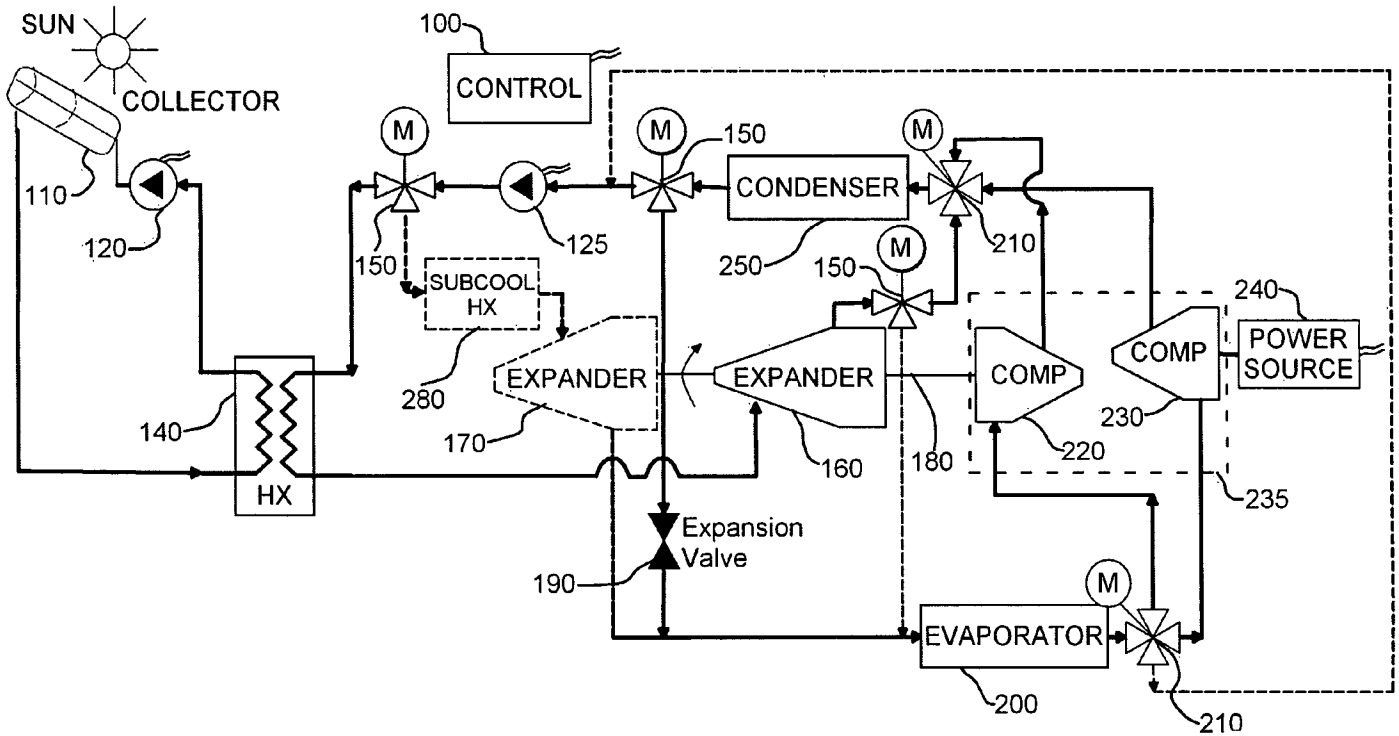
FIG. 8A illustrates a high level block diagram of an exemplary embodiment of the operation of apparatus of FIG. 2A, utilizing only a vapor phase expander.

FIG. 8A illustrates a high level block diagram of an exemplary embodiment of the apparatus of FIG. 2A, utilizing only a single expander. The connections between each of: the third tap of first three way valve 150 and the input of subcooling heat exchanger 280; the output of subcooling heat exchanger 280 and the input of second expander 170; the output of second expander 170 and the input of evaporator 200; the third tap of second three way valve 150 and the input of evaporator 200; and the fourth tap of first four way valve 210 and the input of second pump 125 are illustrated as a dashed line since they are not used in the waste heat driven cooling cycle of FIG. 8A. Second expander 170 and subcooler 280 are further illustrated with dashed lines since it is not utilized in the embodiment of FIG. 8A. For the sake of simplicity, first and second expanders 160 and 170, and the associated valves, are illustrated as described above in relation to FIG. 1A, however this is not meant to be limiting in any way. In another embodiment first and second expanders 160, 170 each drive a respective driving member each associated with a respective compressor, without exceeding the scope.

Figure 8B:
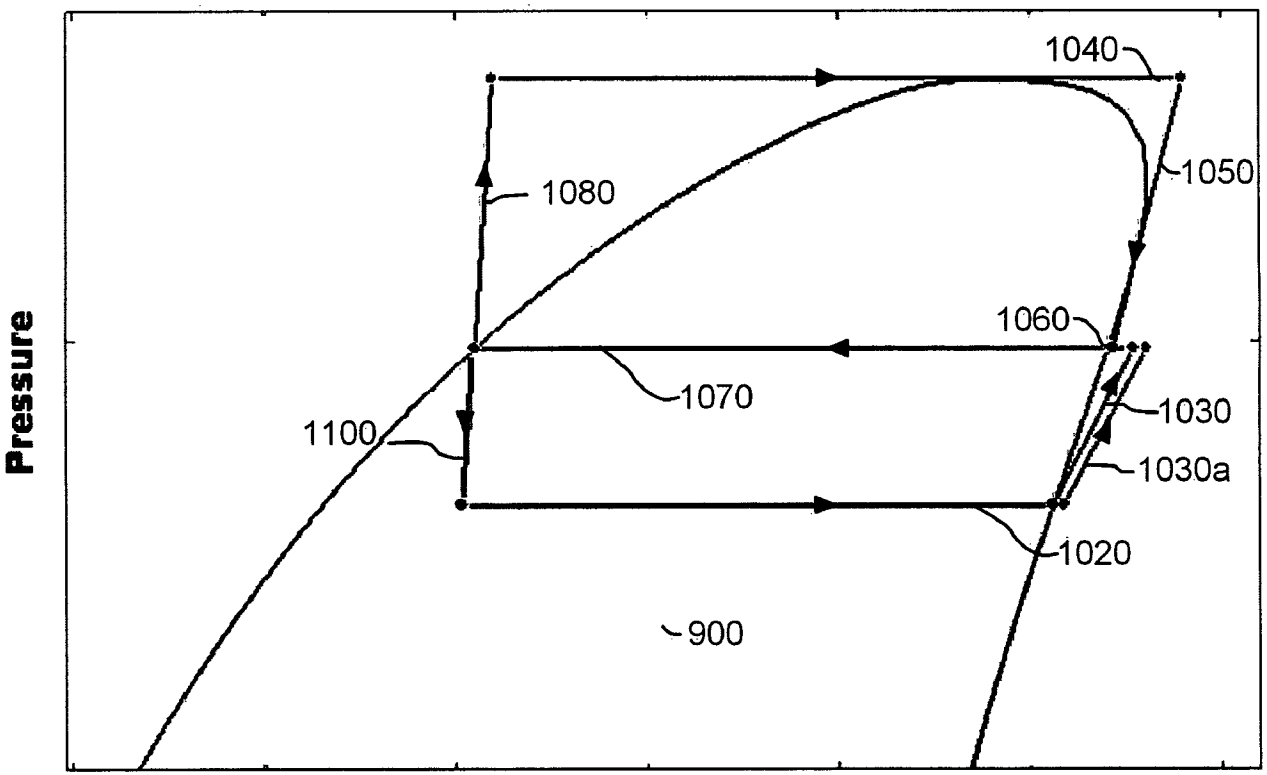
FIG. 8B illustrates a thermodynamic process in a pressure enthalpy diagram for the waste heat driven cooling cycle of FIG. 8A.

FIG. 8B illustrates a pressure enthalpy diagram for the waste heat driven cooling cycle of FIG. 8A, in which the x-axis represents enthalpy, and the y-axis represents pressure. Area 900 represents the wet vapor region for the refrigerant.

In operation, and with reference to both FIG. 8A and FIG. 8B, heated fluid from waste heat source 110 is forced through the heat source conduit of heat exchanger 140 by first pump 120. Pressurized liquid refrigerant, which in one non-limiting embodiment is R-134a, and in one non-limiting embodiment is pressurized at 3-4 MPa, is forced into first three way valve 150 by second pump 125. Control element 100 is operative to control first three way valve 150 so as to pass the pressurized liquid refrigerant into the heat receiving conduit of heat exchanger 140, where it is heated to a superheated vapor state, as shown in process 1040. In one embodiment, the refrigerant is heated in the heat receiving conduit of heat exchanger 140 to a temperature of 85-115° C.

The superheated vapor state refrigerant exiting the heat receiving conduit of heat exchanger 140 is fed to first expander 160, which may be implemented as a gas turbine or a scroll or screw expander, without limitation, and is operative to expand the refrigerant thereby reducing the pressure and the temperature of the refrigerant as shown in process 1050, while retaining the refrigerant in a slightly superheated vapor state and reducing the pressure of the refrigerant to a pressure consonant with the output of first and second compressors 220 and 230 described below. First expander 160 is further operative to produce mechanical work, particularly to impart rotational force to driving member 180. The operation of first expander 160 is controlled by control element 100. In one embodiment, control element 100 receives an input indicative of the rotation rate of first expander 160. In one embodiment an integrated control valve is provided at the input of first expander 160, the integrated control valve operative responsive to control element 100 to adjust the flow of refrigerant entering second expander 170. In another embodiment, control element 100 is operative to control first expander 160 by adjusting the settings of one or more of first and second three way valves 150 so as to retain the refrigerant in a slightly superheated state and reduce the pressure of the refrigerant to a pressure consonant with the output of first and second compressors 220 and 230.

The refrigerant exiting first expander 160 is passed into condenser 250 and condensed into a liquid state, as shown in process 1070. A portion of the liquid refrigerant exiting condenser 250 is transferred into second pump 125 and pumped to an increased pressure as shown in process 1080. The balance of the liquid refrigerant exiting condenser 250 is passed into expansion valve 190, where it is expanded, as shown in process 1100. In one embodiment, expansion valve 190 is operative to convert a portion of the liquid refrigerant to a vapor state. The output of expansion valve 190 is fed to evaporator 200, where it completely evaporates as shown in process 1020 providing cooling for the surrounding space.

The output of evaporator 200 is split by first four way valve 210 and a first portion of the output of evaporator 200 is fed to the input of first compressor 220 and a second portion of the output of evaporator 200 is fed to the input of second compressor 230. The ratio of the first portion fed to first compressor 220 to the second portion fed to second compressor 230 is determined by control element 100 responsive to the power available from driving member 180. First and second compressors 220 and 230 are operative to compress the expanded vapor refrigerant received from evaporator 200, as shown in process 1030 and 1030A, respectively, to a slightly superheated vapor state. In one non-limiting embodiment, the slightly superheated vapor state is at a temperature of 40-55° C.

Second four way valve 210 is operative to receive the outputs of first and second compressors 220 and 230 and the output of first expander 160 via second three way valve 150, which as indicated above are at consonant pressures, mix the flows into a combined vapor exhibiting a unitary temperature and pressure, as shown in process 1060, and feed the combined refrigerant in vapor form to the input of condenser 250. Condenser 250, preferably in cooperation with ambient air or other cooling source, is operative to condense the received combined refrigerant to a liquid state, as shown in process 1070. A portion of the liquid state refrigerant exiting condenser 250 is transferred to second pump 125 through third three way valve 150, and pumped to an increased pressure as shown in process 1080, thus completing the cycle. As described above, in one non-limiting embodiment second pump 125 is operative to increase the pressure of the liquid refrigerant to a pressure of 3-4 MPa. The balance of the liquid state refrigerant exiting condenser 250 is passed to expansion valve 190, as described above.

Expansion valve 190 thus performs the expansion function of second expander 170 described above in the combined state dual waste heat driven cooling cycle of FIG. 1A and in the combined state waste heat driven cooling cycle of FIG. 2A, without providing the additional mechanical work. Thus, efficiency is reduced, however the cost of second expander 170 is saved.

Thus, the present embodiments enable the provision of air conditioning from waste heat with an improved COP, preferably by the use of a vapor phase expander, and further preferably in cooperation with an additional liquid phase expander. The arrangement exhibits flexibility allowing for operation in cooperation with an additional power source in the absence of sufficient waste heat.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

The terms "include", "comprise" and "have" and their conjugates as used herein mean "including but not necessarily limited to". The term "connected" is not limited to a direct connection, and connection via intermediary devices is specifically included.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

We claim:

1. An apparatus arranged to provide air conditioning comprising:

a control element;

a driving member;

a first heat exchanger;

a liquid state expander arranged to produce mechanical work as a first rotational force to said driving member responsive to refrigerant in a liquid state;

a vapor state expander arranged to produce mechanical work as a second rotational force to said driving member responsive to a refrigerant in a superheated vapor state;

a second heat exchanger;

a compressor driven by said driving member;

a condenser; and an evaporator, wherein in a waste heat cooling mode said control element is arranged to:

feed a first portion of the output of said condenser to said liquid state expander via said first heat exchanger, said first portion in a liquid state at the input to said liquid state expander;

feed a second portion of the output of said condenser to said vapor state expander via said second heat exchanger, said fed second portion in a vapor state at the input to said vapor state expander responsive to heat received via said second heat exchanger;

feed the output of said liquid state expander to said evaporator;

feed a first portion of the output of said evaporator to the input of said compressor; and feed the output of said compressor and the output of said vapor state expander to the input of said condenser.

2. The apparatus according to claim 1, further comprising and an additional power driven compressor, and wherein in an additional power source supported waste heat cooling mode said control element is arranged to:

feed a second portion of the output of said evaporator to said additional power driven compressor; and feed the output of said additional power driven compressor expander to the input of said condenser.

3. The apparatus according to claim 1, wherein in the waste heat cooling mode the pressure of the output of said vapor state expander is consonant with the pressure of the output of said compressor.

4. The apparatus according to claim 3, wherein said first heat exchanger and said second heat exchanger are arranged to transfer heat from a single waste heat source.

5. The apparatus according to claim 1, wherein said first heat exchanger is a subcooling heat exchanger.

6. The apparatus according to claim 1, further comprising a pump responsive to said control element, wherein in the waste heat cooling mode said control element is arranged to drive the refrigerant into said first heat exchanger via said pump.

7. The apparatus according to claim 1, further comprising a pump responsive to said control element, and wherein in a waste heat driven heating mode said control element is arranged to:

drive refrigerant into said first heat exchanger via said pump;

feed the refrigerant exiting said first heat exchanger to said second heat exchanger; and feed the output of said evaporator to the input of said pump.

8. The apparatus according to claim 1, wherein in a combined state waste heat cooling mode said control element is arranged to:

feed a first portion of the output of said condenser to said first heat exchanger;

feed a second portion of the output of said condenser to said second heat exchanger; and feed the output of said liquid state expander to the input of said evaporator.

9. The apparatus according to claim 8, wherein in the combined state waste heat cooling mode the pressure of the output of said vapor state expander is consonant with the pressure of the output of said compressor unit.

10. The apparatus according to claim 8, wherein at least one of said first heat exchanger and said second heat exchanger is arranged to transfer heat from a solar collector.

11. The apparatus according to claim 8, further comprising a pump responsive to said control element, and wherein in a waste heat driven heating mode said control element is arranged to:

feed, via said pump, the output of said evaporator to said first heat exchanger; and feed the output of said vapor state expander to the input of said evaporator.

12. The apparatus according to claim 1, further comprising an expansion valve, wherein in an additional power driven cooling mode said control element is arranged to:

feed the output of said evaporator to the input of said compressor unit;

feed the output of said compressor unit to the input of said condenser; and feed the output of said condenser to said evaporator via said expansion valve.

13. The apparatus according to claim 1, further comprising an expansion valve, wherein in an additional power driven heating mode said control element is arranged to:

feed the output of said condenser to the input of said compressor unit;

feed the output of said compressor unit to the input of said evaporator; and feed the output of said evaporator to the input of said condenser via said expansion valve.

* * * * *